US008950087B2

(12) United States Patent
Baucom et al.

(10) Patent No.: US 8,950,087 B2
(45) Date of Patent: Feb. 10, 2015

(54) ARTICLE OF FOOTWEAR WITH A CUSTOMIZABLE UPPER

(75) Inventors: Jim Baucom, Portland, OR (US); Clifford B. Gerber, West Linn, OR (US); James A. Grove, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 1282 days.

(21) Appl. No.: 12/358,234

(22) Filed: Jan. 22, 2009

(65) Prior Publication Data

US 2010/0180469 A1 Jul. 22, 2010

(51) Int. Cl.

| | |
|---|---|
| ***A43B 23/26*** | (2006.01) |
| ***A43B 3/24*** | (2006.01) |
| ***A43B 23/07*** | (2006.01) |
| ***A43B 23/16*** | (2006.01) |
| ***A43B 5/00*** | (2006.01) |
| ***A43B 23/22*** | (2006.01) |
| ***A43B 3/00*** | (2006.01) |
| ***A43C 11/14*** | (2006.01) |
| ***A43B 23/02*** | (2006.01) |

(52) U.S. Cl.

CPC ..... *A43B 23/22* (2013.01); *A43B 3/0031* (2013.01); *A43B 3/0047* (2013.01); *A43B 3/242* (2013.01); *A43C 11/1493* (2013.01); *A43B 23/0235* (2013.01)

USPC ..... 36/54; 36/100; 36/101; 36/55; 36/89; 36/133

(58) Field of Classification Search

CPC ..... A43B 7/20; A43B 7/149; A43B 23/07; A43B 23/24; A43B 23/26; A43B 3/24; A43B 3/244; A43B 3/242; A43B 3/0078

USPC ..... 36/71, 10, 89, 113, 114, 100, 101, 132, 36/133, 136, 50.1, 55, 160

See application file for complete search history.

(56) References Cited

U.S. PATENT DOCUMENTS

| | | | | | |
|---|---|---|---|---|---|
| 387,119 | A | * | 7/1888 | Stevens | 36/89 |
| 3,564,335 | A | * | 2/1971 | Siegel | 361/223 |
| 3,613,273 | A | * | 10/1971 | Marquis | 36/89 |
| 4,083,127 | A | * | 4/1978 | Hanson | 36/93 |
| 4,132,016 | A | * | 1/1979 | Vaccari | 36/114 |
| 4,422,249 | A | * | 12/1983 | Hannah | 36/133 |
| 4,922,630 | A | * | 5/1990 | Robinson | 36/89 |
| 5,175,947 | A | * | 1/1993 | Parracho | 36/89 |
| 5,365,677 | A | * | 11/1994 | Dalhgren | 36/3 A |
| 5,400,529 | A | * | 3/1995 | Bell et al. | 36/93 |
| 5,430,960 | A | * | 7/1995 | Richardson | 36/89 |

(Continued)

FOREIGN PATENT DOCUMENTS

| | | |
|---|---|---|
| GB | 2 172 191 | 9/1986 |
| JP | 05-253007 | 10/1993 |
| WO | WO 2007/096914 | 8/2007 |

*Primary Examiner* — Khoa Huynh
*Assistant Examiner* — Timothy K Trieu
(74) *Attorney, Agent, or Firm* — Plumsea Law Group, LLC

(57) ABSTRACT

An article of footwear with an insert system is disclosed. The insert system can include an insert that may be introduced to a side portion of the upper. The insert is configured to adjust properties of a side portion of an upper. The insert system can include a lateral insert configured to be inserted into an upper and associated with an inner surface of the lateral side portion. The system can also include a medial insert configured to be inserted into the upper and associated with an inner surface of the medial side portion.

20 Claims, 23 Drawing Sheets

(56) References Cited

U.S. PATENT DOCUMENTS

| | | | | |
|---|---|---|---|---|
| 5,528,841 | A * | 6/1996 | Pozzobon | 36/3 A |
| 5,606,808 | A * | 3/1997 | Gilliard et al. | 36/89 |
| 5,771,608 | A | 6/1998 | Peterson | |
| 5,799,417 | A * | 9/1998 | Burke et al. | 36/105 |
| 6,079,128 | A * | 6/2000 | Hoshizaki et al. | 36/89 |
| 6,604,303 | B2 | 8/2003 | Covatch | |
| 6,681,503 | B2 * | 1/2004 | Morle | 36/99 |
| 6,715,218 | B2 * | 4/2004 | Johnson | 36/89 |
| 6,785,985 | B2 | 9/2004 | Marvin et al. | |
| D498,583 | S * | 11/2004 | Yun | D2/972 |
| 6,895,696 | B1 * | 5/2005 | Sanders | 36/54 |
| 6,993,859 | B2 * | 2/2006 | Martin et al. | 36/50.5 |
| 7,017,286 | B2 | 3/2006 | Covatch | |
| 7,028,420 | B2 | 4/2006 | Tonkel | |
| 7,047,668 | B2 * | 5/2006 | Burris et al. | 36/3 A |
| 7,047,670 | B2 | 5/2006 | Marvin et al. | |
| 7,117,614 | B2 | 10/2006 | Tonkel | |
| 7,131,219 | B2 * | 11/2006 | Chen et al. | 36/89 |
| 7,140,129 | B2 * | 11/2006 | Newson et al. | 36/100 |
| 7,168,188 | B2 * | 1/2007 | Auger et al. | 36/69 |
| 7,171,766 | B2 * | 2/2007 | Bouche et al. | 36/89 |
| 7,331,128 | B1 | 2/2008 | Navasky et al. | |
| 7,337,560 | B2 | 3/2008 | Marvin et al. | |
| 7,377,058 | B2 * | 5/2008 | Elkington et al. | 36/117.6 |
| 7,600,334 | B2 * | 10/2009 | Cox et al. | 36/136 |
| 7,644,517 | B2 * | 1/2010 | Gerber | 36/11.5 |
| 7,918,811 | B2 * | 4/2011 | Lussier et al. | 602/23 |
| 7,941,943 | B2 * | 5/2011 | Baker et al. | 36/54 |
| 7,966,748 | B2 * | 6/2011 | Votolato | 36/15 |
| 7,975,403 | B2 * | 7/2011 | Mosher | 36/51 |
| 8,161,665 | B2 * | 4/2012 | Nakano | 36/55 |
| 8,196,320 | B2 * | 6/2012 | Adami et al. | 36/100 |
| 8,359,769 | B2 * | 1/2013 | Vattes et al. | 36/3 A |
| 8,484,865 | B2 * | 7/2013 | Baker et al. | 36/54 |
| 8,632,342 | B2 * | 1/2014 | Morag | 434/251 |
| 8,661,712 | B2 * | 3/2014 | Aveni et al. | 36/54 |
| 2002/0029494 | A1 * | 3/2002 | Small | 36/54 |
| 2003/0159312 | A1 * | 8/2003 | Farys et al. | 36/51 |
| 2005/0016032 | A1 * | 1/2005 | Cox et al. | 36/136 |
| 2005/0102856 | A1 * | 5/2005 | Jones et al. | 36/3 R |
| 2005/0178026 | A1 * | 8/2005 | Friton | 36/50.1 |
| 2005/0188562 | A1 * | 9/2005 | Clarke et al. | 36/15 |
| 2005/0241189 | A1 * | 11/2005 | Elkington et al. | 36/117.6 |
| 2005/0252036 | A1 | 11/2005 | Laska | |
| 2006/0116483 | A1 | 6/2006 | Tonkel | |
| 2006/0137226 | A1 * | 6/2006 | Jung et al. | 36/89 |
| 2006/0143951 | A1 * | 7/2006 | Yang et al. | 36/100 |
| 2006/0213087 | A1 * | 9/2006 | Gallegos | 36/97 |
| 2006/0277785 | A1 | 12/2006 | Vattes et al. | |
| 2006/0277786 | A1 | 12/2006 | Vattes et al. | |
| 2006/0277787 | A1 | 12/2006 | Vattes et al. | |
| 2006/0288610 | A1 | 12/2006 | Laska et al. | |
| 2006/0288614 | A1 | 12/2006 | Tonkel | |
| 2007/0044346 | A1 * | 3/2007 | Ungari et al. | 36/136 |
| 2008/0086915 | A1 * | 4/2008 | Cox et al. | 36/101 |
| 2008/0098620 | A1 | 5/2008 | Marvin et al. | |

* cited by examiner

ARTICLE OF FOOTWEAR WITH A CUSTOMIZABLE UPPER

BACKGROUND

The present invention relates to an article of footwear, and in particular to an article of footwear with a customizable upper.

Articles with inserts have been previously proposed. Vates (U.S. patent publication number 2006/0277785) teaches a shoe having vamp openings and body and tongue chimney structures that may be removable from a shoe. The shoe includes an upper partially comprised of a material that has openings. The material covers body chimney structure, which is located within the shoe and visible through openings. The chimney structures can be removably inserted into the footwear.

Scerri (UK patent application GB2172191) teaches a shoe having a sole and a vamp. The vamp comprises a flexible inner vamp member and a transparent flexible outer vamp member. The outer vamp member is coupled to the inner vamp member so as to form a vamp envelope for removably receiving a thin flexible vamp insert.

The related art lacks provisions for coupling an insert with a portion of an upper. There is a need in the art for a design that overcomes these shortcomings.

SUMMARY

The invention discloses an article of footwear with an insert system. In one aspect, the invention provides an article of footwear, comprising: an upper including a side portion, the side portion further including an outer portion and an inner portion; the side portion including at least one aperture; an insert configured to be inserted into the upper and associated with the inner portion of the side portion; the insert including at least one raised portion; and where at least one raised portion can be inserted through at least one aperture and exposed on the outer portion.

In another aspect, the invention provides an article of footwear, comprising: an upper including a side portion, the side portion further including an outer portion and an inner portion; the side portion including a plurality of apertures; an insert configured to be inserted into the upper and associated with the inner portion of the side portion; the insert including a plurality of raised portions that are configured to engage the plurality of apertures; and where the raised portions and the outer portion of the upper form a substantially continuous outer surface when the insert is disposed inside the upper.

In another aspect, the invention provides an article of footwear, comprising: an upper including at least one side portion, at least one side portion further including an outer portion and an inner portion; at least one side portion including at least one aperture; at least one insert configured to be inserted into the upper and associated with the inner portion of at least one side portion, at least one insert including an ankle portion that extends from a throat of the upper when the insert is inserted into the upper; an ankle strap fixedly connected to a portion of at least one insert; and where the ankle strap is configured to engage at least one strap receiving portion disposed near an opening of the upper and wherein the ankle strap is configured to tighten the upper at an ankle portion of the article.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF ONE EMBODIMENT

Figure 1:
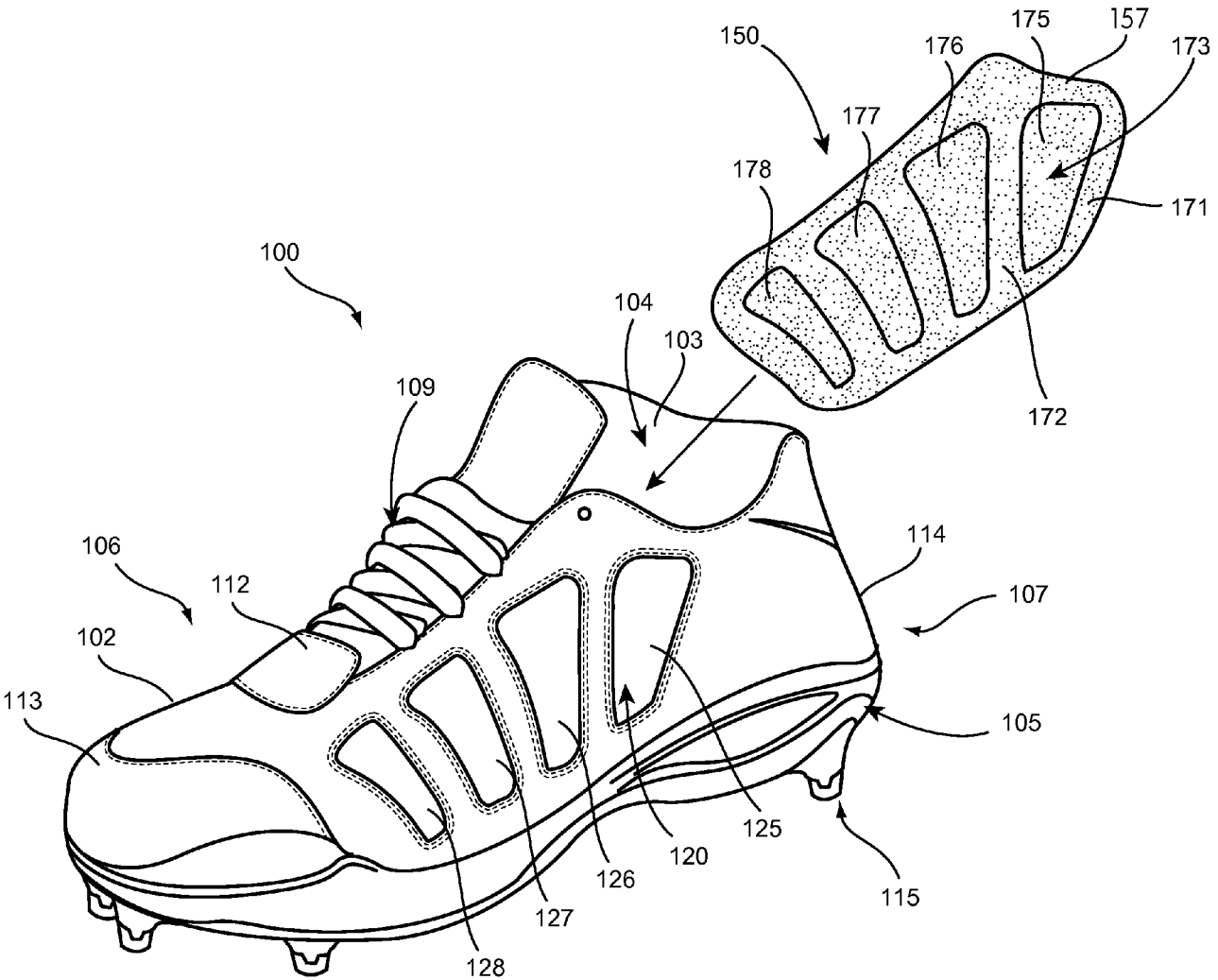
FIG. 1 is an isometric view of an exemplary embodiment of an article of footwear associated with an insert system including a lateral insert.
Figure 2:
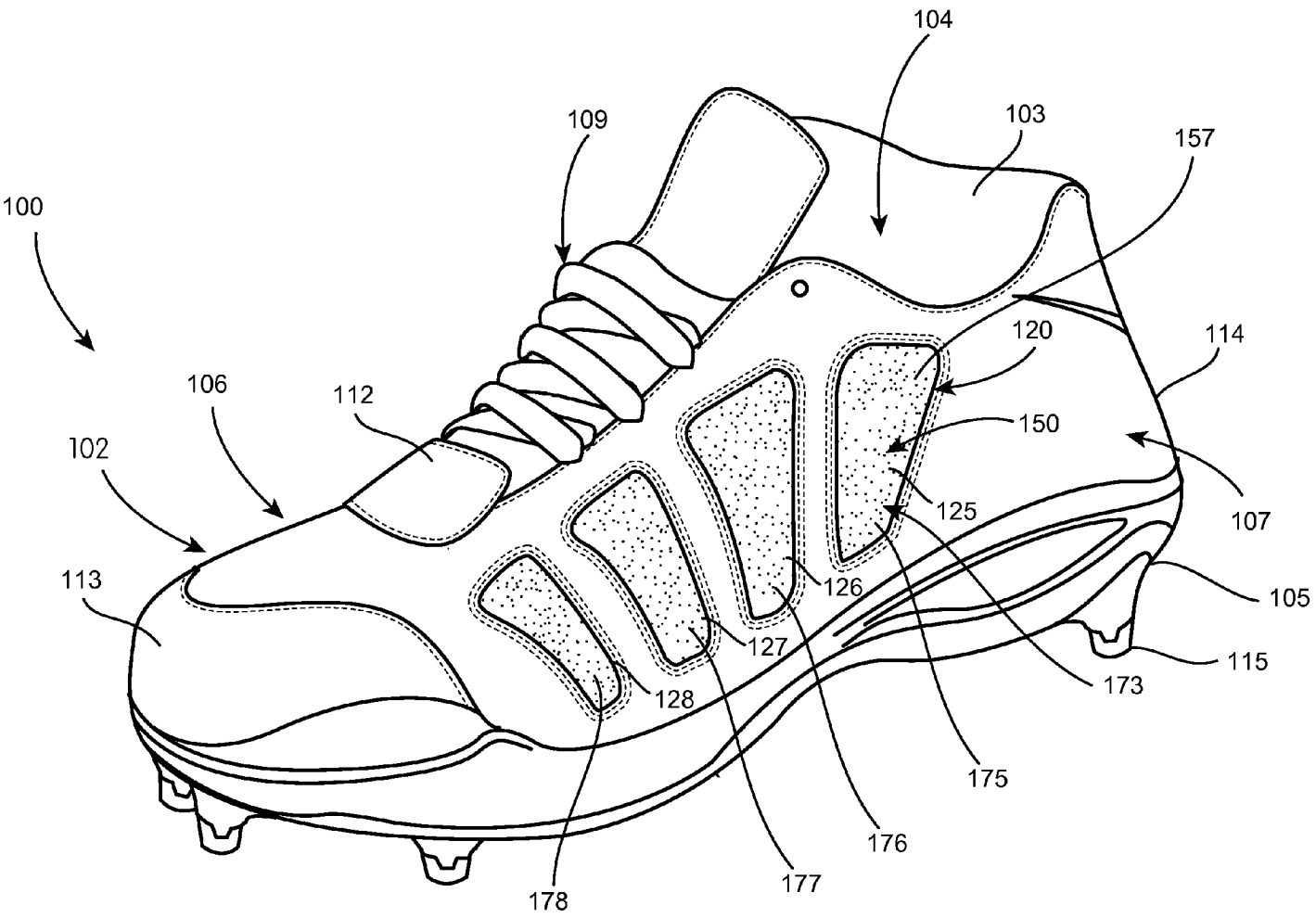
FIG. 2 is an isometric view of an exemplary embodiment of an article with an insert system including a lateral insert.

FIGS. 1 and 2 illustrate an exemplary embodiment of article of footwear 100. For clarity, the following detailed description discusses an exemplary embodiment, in the form of a football shoe, but it should be noted that the present invention could take the form of any article of footwear including, but not limited to: soccer shoes, sneakers, football shoes, rugby shoes, baseball shoes as well as other kinds of shoes. As shown in FIGS. 1 and 2, article of footwear 100, also referred to simply as article 100, is intended to be used with a left foot; however, it should be understood that the following discussion may equally apply to a mirror image of article of footwear 100 that is intended for use with a right foot.

Article of footwear 100 includes upper 102. Generally, upper 102 may be any type of upper. In particular, upper 102 could have any design, shape, size and/or color. For example, in embodiments where upper 102 is a basketball shoe, upper 102 could be a high top upper that is shaped to provide high support on an ankle. In embodiments where upper 102 is a running shoe, upper 102 could be a low top upper.

Upper 102 is configured to receive a foot of a wearer. In some embodiments, upper 102 includes throat 103 configured to receive a foot of a wearer. Typically, throat 103 allows a foot to be inserted into interior cavity 104 of upper 102.

In some embodiments, upper 102 may include toe portion 113 that is associated with the toes of a foot inserted within upper 102. Also, upper 102 may include heel portion 114 that is associated with a heel of a foot. Additionally, upper 102 can include middle portion 112 that is disposed between toe portion 113 and heel portion 114. Middle portion 112 is associated with a midfoot, including an arch of the foot and a top of the foot.

In some embodiments, article of footwear 100 may include a fastening system configured to tighten upper 102. Generally, article of footwear 100 could be associated with any type of fastening system including, but not limited to: laces, straps, zippers, hook and loop fasteners, as well as other types of fastening systems. In one embodiment, article of footwear 100 includes a fastening system with a lace.

Figure 10:
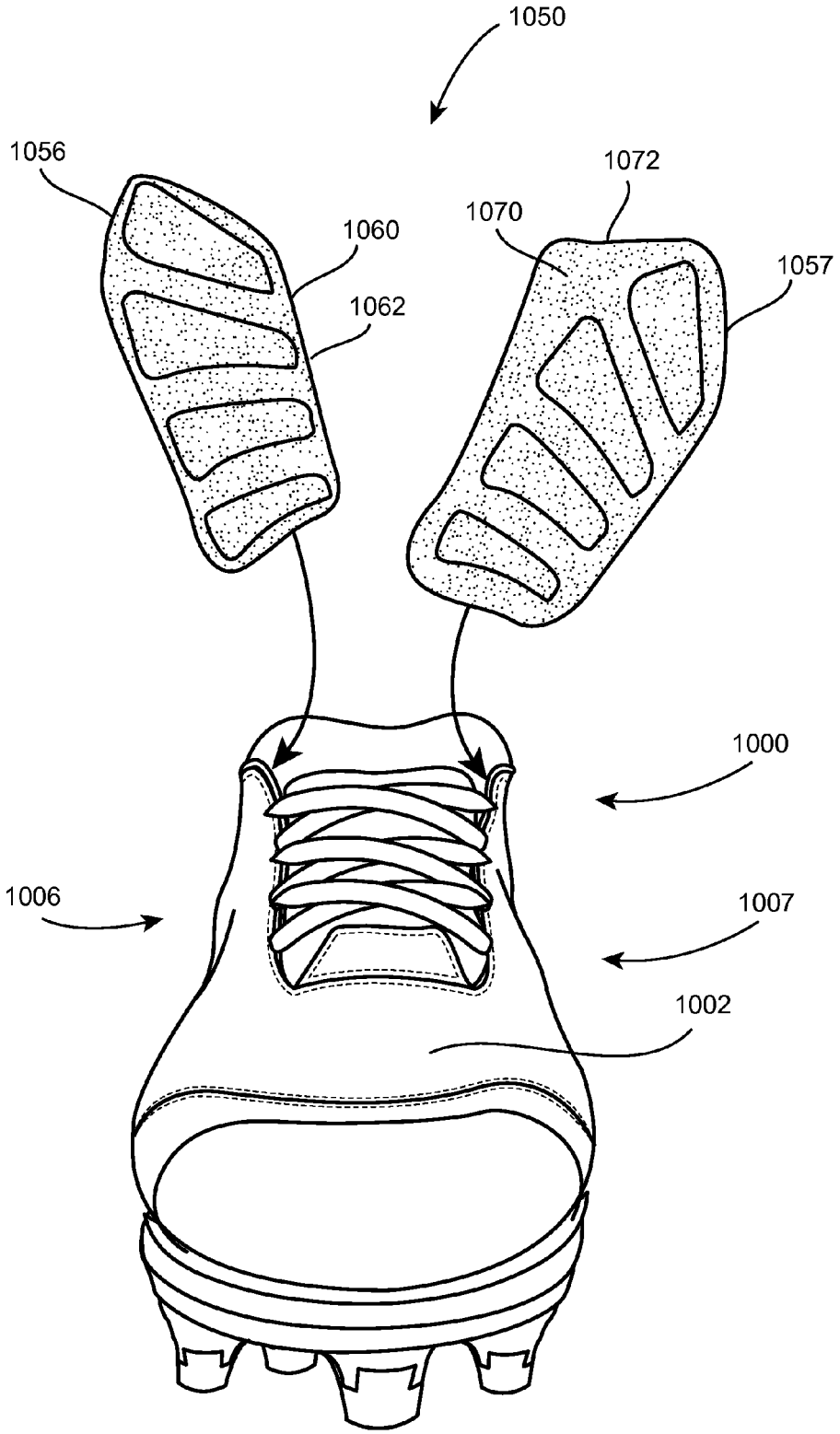
FIG. 10 is a front view of an exemplary embodiment of a medial insert and a lateral insert associated with an article of footwear.

In an exemplary embodiment, article of footwear 100 may include lacing portion 109. Generally, lacing portion 109 may be disposed on any portion of upper 102. In some embodiments, lacing portion 109 may be disposed symmetrically on middle portion 112. In other embodiments, lacing portion 109 may be disposed asymmetrically on middle portion 112. In one embodiment, lacing portion 109 may be disposed in a substantially symmetrical manner on middle portion 112. As shown in FIG. 10, lacing portion 109 may be disposed between a medial free edge disposed on a medial side of a top portion of upper 102 and a lateral free edge disposed on a lateral side of the top portion of upper 102.

Upper 102 may include lateral side portion 107. Lateral side portion 107 may be associated with an outside of a foot. In particular, lateral side portion 107 may be bounded by heel portion 114, lacing portion 109 and toe portion 113. In a similar manner, upper 102 may include medial side portion 106 disposed opposite lateral side portion 107. Medial side portion 106 may be bounded by heel portion 114, lacing portion 109 and toe portion 113. With this arrangement, medial side portion 106 may be associated with an inside of a foot.

In some embodiments, upper 102 may be associated with sole 105. In different embodiments, sole 105 may include different components. For example, sole 105 may include an outsole, midsole and/or insole.

In some embodiments, sole 105 may include provisions to increase traction with a ground surface. Examples of provisions to increase traction include, but are not limited to: traction elements as well as cleats. In one embodiment, sole 105 may be configured with cleats 115 to increase traction with a ground surface.

Generally, each component of article of footwear 100 may be constructed of any material. Sole 105 may be constructed from any suitable material, including but not limited to: elastomers, siloxanes, natural rubber, other synthetic rubbers, aluminum, steel, natural leather, synthetic leather, or plastics. Also, upper 102 may be made from any suitable material, including but not limited to: nylon, natural leather, synthetic leather, natural rubber, or synthetic rubber.

An article of footwear may include provisions for adjusting properties of a side portion of an upper. In particular, an article may include provisions to adjust the stiffness, thickness, shape, and insulating properties of a side portion of an upper. In some embodiments, an article can include an insert system that may be associated with a side portion of an article to adjust properties of the side portion.

In one embodiment, article 100 may be associated with insert system 150. Insert system 150 may include lateral insert 157. In some cases, insert system 150 may also include a medial insert that will be discussed later in this detailed description. Lateral insert 157 may be configured to be inserted into upper 102. With this arrangement, lateral insert 157 and a medial insert may adjust properties of lateral side portion 107 and medial side portion 106, respectively, of upper 102.

Referring to FIG. 1, lateral insert 157 includes peripheral portion 171 associated with a periphery of lateral insert 157. Lateral insert 157 may also include central portion 172. Central portion 172 may be disposed inward of peripheral portion 171.

In different embodiments, an insert may be configured in different shapes. Examples of shapes, include, but are not limited to: square shapes, rectangular shapes, elliptical shapes, triangular shapes, regular shapes, irregular shapes as well as other types of shapes. In an exemplary embodiment, lateral insert 157 is configured with an irregular shape.

In some embodiments, lateral insert 157 may be configured with one or more corners. In one embodiment, lateral insert 157 may comprise five generally rounded corners. With this arrangement, lateral insert 157 may fit contours of lateral side portion 107.

In different embodiments, lateral insert 157 may adjust different properties of lateral side portion 107. For example, in some embodiments, lateral insert 157 may be relatively rigid to provide support to lateral side portion 107. In some cases, lateral insert 157 may provide additional padding to protect a lateral side of a foot.

In one embodiment, lateral insert 157 includes plurality of raised portions 173. Plurality of raised portions 173 can be disposed in central portion 172 of lateral insert 157. In some cases, plurality of raised portions 173 may be disposed within central portion 172 so that peripheral portion 171 extends outward from plurality of raised portions 173.

Generally, plurality of raised portions 173 can include any number of raised portions. In some embodiments, plurality of raised portions 173 can include more than four raised portions. In other embodiments, plurality of raised portions 173 can include less than four raised portions. In one embodiment, plurality of raised portions 173 may include four raised portions. In particular, plurality of raised portions 173 includes first raised portion 175, second raised portion 176, third raised portion 177 and fourth raised portion 178.

In different embodiments, plurality of raised portions 173 may be configured with various shapes and sizes. Examples of shapes, include, but are not limited to: square shapes, rectangular shapes, elliptical shapes, triangular shapes, regular shapes, irregular shapes as well as other types of shapes. In one embodiment, plurality of raised portions 173 is configured with rounded rectangular shapes.

Plurality of raised portions 173 may be configured with various heights with respect to central portion 172. In some embodiments, plurality of raised portions 173 may be raised slightly with respect to central portion 172. In other embodiments, plurality of raised portions 173 may be raised significantly with respect to central portion 172. This will be discussed in greater detail later in this detailed description.

In some embodiments, plurality of raised portions 173 can provide more padding for lateral insert 157. In some cases, additional padding can improve the insulating capabilities of upper 102. In other cases, additional padding can protect a foot disposed within upper 102. In other embodiments, plurality of raised portions 173 can provide greater stiffness for lateral insert 157.

A side portion of an upper can include various provisions for receiving an insert system. In some embodiments, a side portion can be configured with apertures for receiving a plurality of raised portions of an insert. In other embodiments, a side portion can be configured without apertures and receive an insert with a plurality of raised portions.

Generally, an aperture in an upper can be formed in various manners known in the art. In some embodiments, an aperture may be formed by removing portions of an upper. In some cases, an aperture can provide an opening to an interior cavity of an upper. In other cases, an aperture may be covered so that it does not form an opening to an interior cavity of an upper.

Referring to FIG. 1, lateral side portion 107 includes plurality of apertures 120. Plurality of apertures 120 may include any number of apertures. In some embodiments, plurality of apertures 120 can include more than four apertures. In other embodiments, plurality of apertures 120 can include less than four apertures. In an exemplary embodiment, plurality of apertures 120 can include four apertures. In particular, plurality of apertures 120 can include first aperture 125, second aperture 126, third aperture 127 and fourth aperture 128.

In different embodiments, plurality of apertures 120 may be configured in various shapes. Examples of shape, include, but are not limited to: square shapes, rectangular shapes, elliptical shapes, triangular shapes, regular shapes, irregular shapes as well as other types of shapes. In one embodiment, plurality of apertures 120 is configured with rounded rectangular shapes. With this arrangement, plurality of apertures 120 may be configured to receive plurality of raised portions 173.

Generally, plurality of apertures 120 may be arranged in various patterns on lateral side portion 107. For example, plurality of apertures 120 may be arranged in a generally longitudinal direction. The term "longitudinal" as used throughout this detailed description and in the claims refers to a direction extending a length of an article. In other embodiments, plurality of apertures 120 may be arranged in a generally lateral direction. The term "lateral" as used throughout this detailed description and in the claims refers to a direction extending a width of an article. In still other embodiments, plurality of apertures 120 may be arranged in a direction other than longitudinal or lateral. In an exemplary embodiment, plurality of apertures 120 may be arranged in a generally longitudinal direction.

Referring to FIGS. 1 and 2, lateral insert 157 may be inserted into upper 102 and associated with lateral side portion 107. This arrangement allows plurality of raised portions 173 to engage plurality of apertures 120. In particular, lateral insert 157 may be disposed so that first raised portion 175 engages first aperture 125. Also, second raised portion 176 may engage second aperture 126. In addition, third raised portion 177 may engage third aperture 127. Likewise, fourth raised portion 178 may engage fourth aperture 128. In some cases, plurality of raised portions 173 may protrude through plurality of apertures 120 as plurality of raised portions 173 engage plurality of apertures 120.

Figure 3:
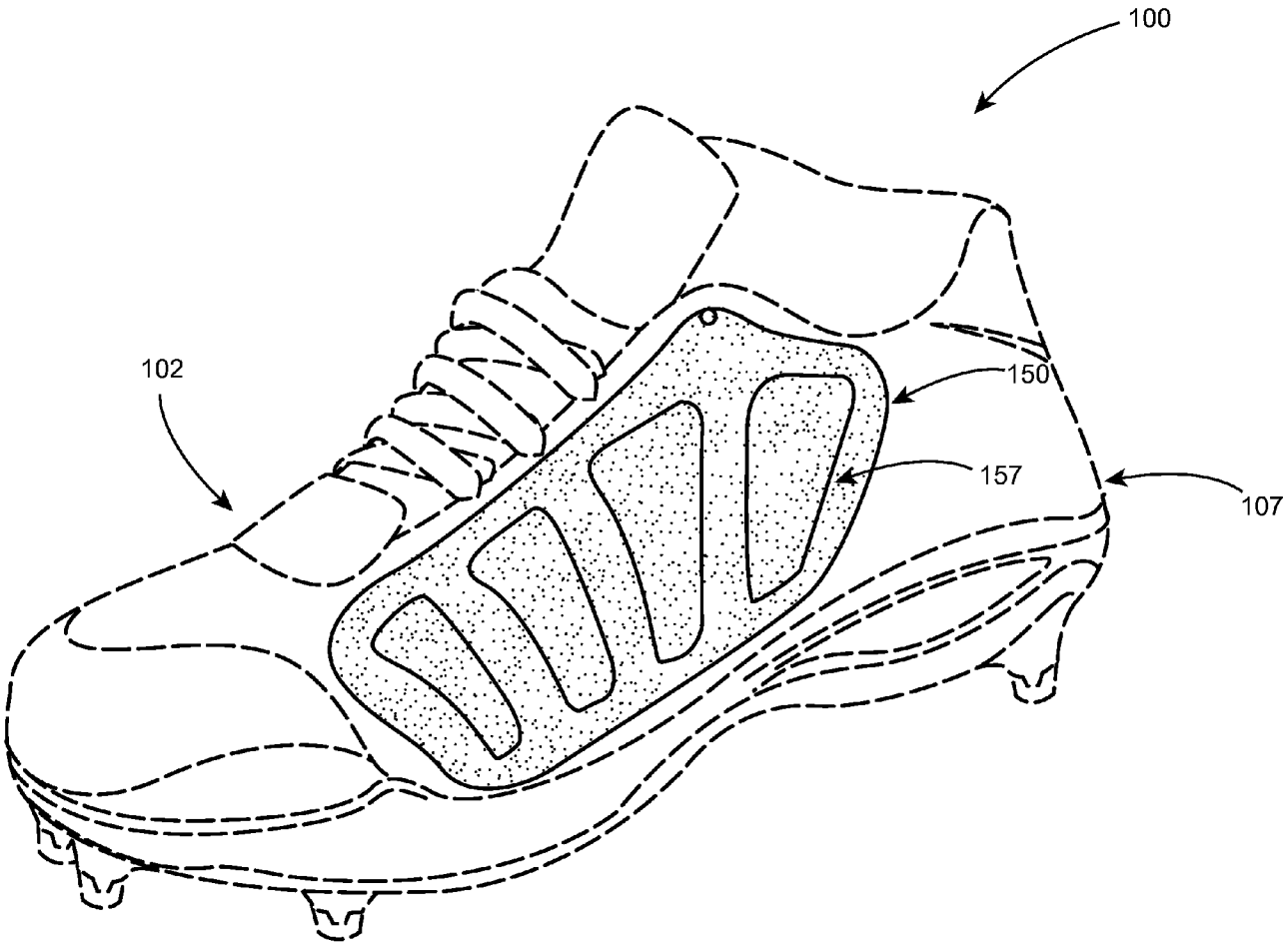
FIG. 3 is an isometric view of an exemplary embodiment of an article illustrated in phantom with a lateral insert.

FIG. 3 is an isometric view of an embodiment of article 100 with lateral insert 157. For purposes of clarity, article 100 is illustrated in phantom so that lateral insert 157 may be clearly seen. With lateral insert 157 associated with lateral side portion 107, lateral insert 157 can provide additional support to lateral side portion 107. Furthermore, lateral insert 157 may also provide additional protection for a lateral side of a foot against impacts with balls or other objects. With this arrangement, lateral insert 157 can provide additional reinforcement for lateral side portion 107.

Figure 4:
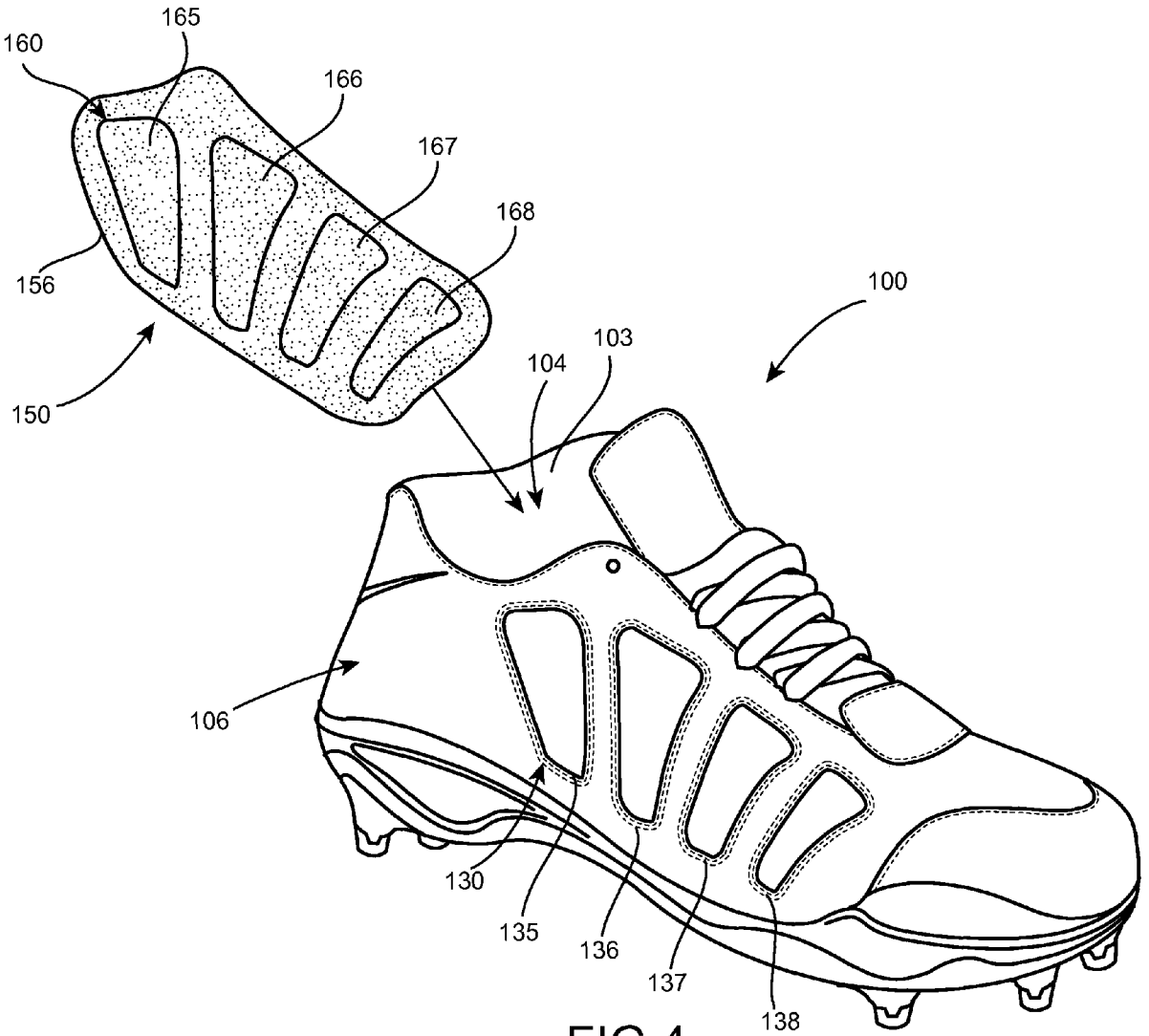
FIG. 4 is an isometric view of an exemplary embodiment of an article associated with an insert system including a medial insert.
Figure 5:
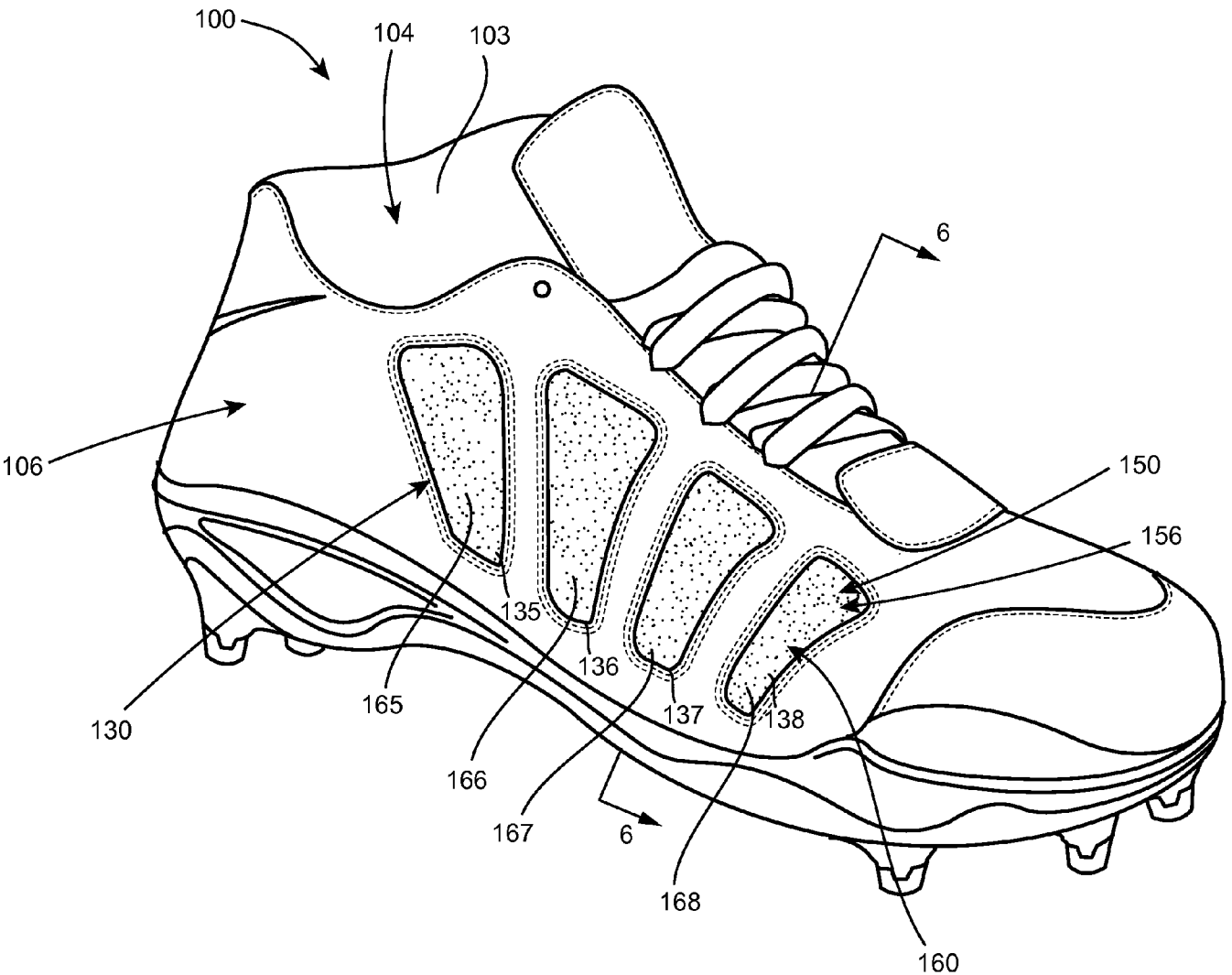
FIG. 5 is an isometric view of an exemplary embodiment of an article with an insert system including a medial insert.

In some embodiments, an article of footwear may be associated with a medial insert and a lateral insert of an insert system. Referring to FIGS. 4 and 5, article of footwear 100 may be associated with medial insert 156 as well as lateral insert 157, as illustrated in FIGS. 1-3, of insert system 150. In some embodiments, medial insert 156 may be substantially similar to lateral insert 157. In particular, medial insert 156 may be configured with a substantially similar shape as lateral insert 157. Furthermore, medial insert 156 may be configured with a substantially similar rigidity and padding as lateral insert 157.

In some embodiments, medial insert 156 may include plurality of raised portions 160. In some cases, plurality of raised portions 160 may be substantially similar to plurality of raised portions 173, as illustrated in FIG. 1. In one embodiment, plurality of raised portions 160 can include first raised portion 165, second raised portion 166, third raised portion 167 and fourth raised portion 168.

In an exemplary embodiment, medial side portion 106 may be configured with plurality of apertures 130. In some cases, plurality of apertures 130 may be substantially similar to plurality of apertures 120 associated with lateral side portion 107, as illustrated in FIGS. 1-3. In particular, plurality of apertures 130 may be configured to receive plurality of raised portions 160 of medial insert 156. In one embodiment, plurality of apertures 130 can comprise first aperture 135, second aperture 136, third aperture 137 and fourth aperture 138.

In one embodiment, medial insert 156 may be inserted into throat 103 and disposed adjacent to medial side portion 106. This arrangement allows plurality of raised portions 160 to engage plurality of apertures 130. In particular, medial insert 156 may be disposed so that first raised portion 165 engages first aperture 135. Also, second raised portion 166 may engage second aperture 136. In addition, third raised portion 167 may engage third aperture 137. Likewise, fourth raised portion 168 may engage fourth aperture 138. With medial insert 156 associated with medial side portion 106, medial insert 156 can provide additional reinforcement for medial side portion 106.

Figure 6:
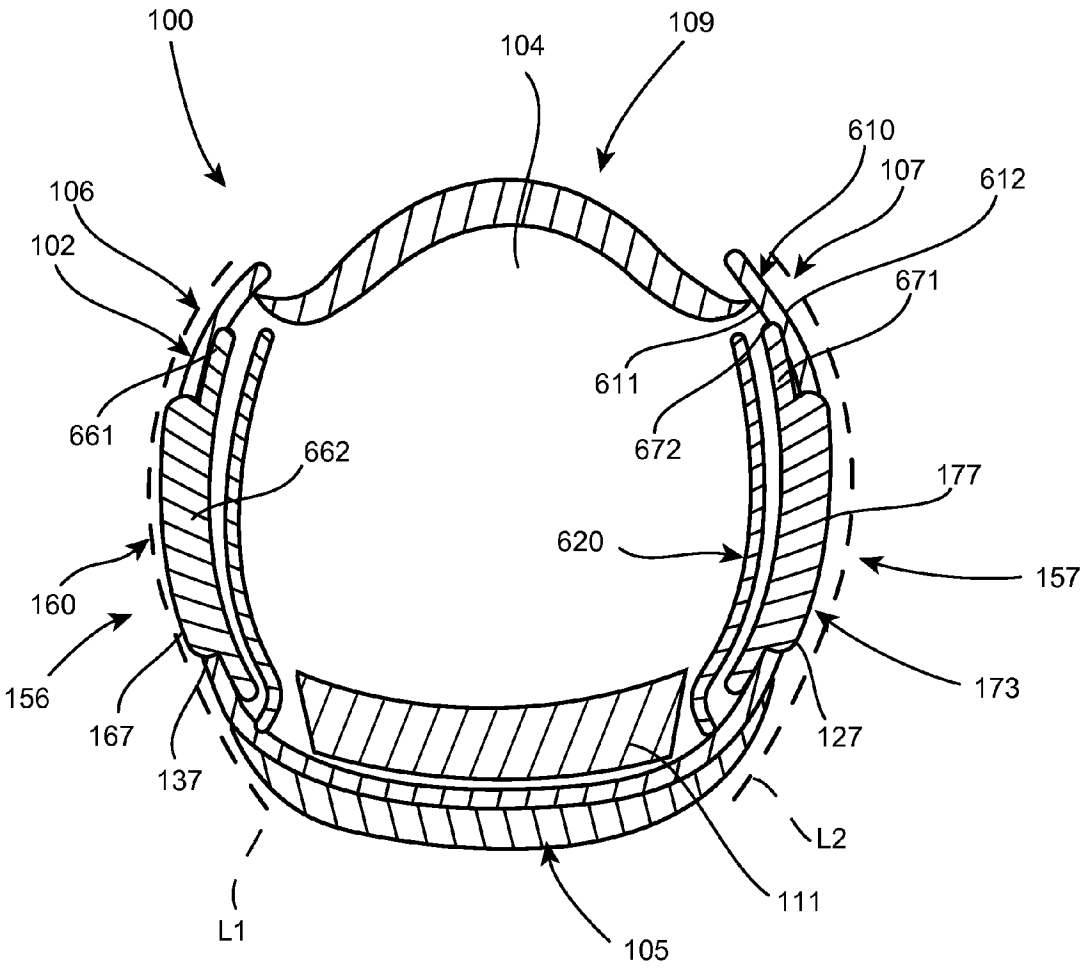
FIG. 6 is a schematic cross sectional view of an exemplary embodiment of an article with a medial and lateral insert.

FIG. 6 illustrates a cross sectional view of an exemplary embodiment of upper 102. In some embodiments, upper 102 may include a sock liner and/or bootie. A sock liner and/or bootie may provide additional comfort to a foot disposed within upper 102. In one embodiment, upper 102 includes sock liner 111. Sock liner 111 may be disposed adjacent to a bottom surface of upper 102. With this arrangement, sock liner 111 may be configured as an insole for sole 105.

As previously discussed, upper 102 may include medial insert 156 and lateral insert 157 of insert system 150. In different embodiments, medial insert 156 and lateral insert 157 may be inserted in different manners within upper 102. In some embodiments, medial insert 156 and lateral insert 157 may be inserted between an outer lining and an inner lining of upper 102.

Upper 102 can include outer lining 610. Outer lining 610 may include inner portion 611. Inner portion 611 may be associated with interior cavity 104. In addition, outer lining 610 can also include outer portion 612 disposed opposite inner portion 611. In some cases, outer portion 612 may be associated with an outer surface of upper 102.

In some embodiments, upper 102 may include inner lining 620. Inner lining 620 may be associated with interior cavity 104 of upper 102. In some cases, inner lining 620 may be configured to form a pocket with outer lining 610.

Medial insert 156 may include first side portion 661. In embodiments with plurality of raised portions 160, first side portion 661 may be associated with plurality of raised portions 160. Medial insert 156 may also include second side portion 662 disposed opposite first side portion 661. In a similar manner, lateral insert 157 may comprise first side portion 671 and second side portion 672. In some cases, first side portion 671 may include plurality of raised portions 173. Second side portion 672 may be disposed opposite first side portion 671.

In some embodiments, first side portion 661 of medial insert 156 may be disposed adjacent to inner portion 611 of outer lining 610 when medial insert 156 is inserted within upper 102. In embodiments including inner lining 620, second side portion 662 may be disposed adjacent to inner lining 620. However, in embodiments without inner lining 620, second side portion 662 may be configured to contact a foot directly when a foot is inserted within upper 102.

Similarly, first side portion 671 of lateral insert 157 may be disposed adjacent to inner portion 611 of outer lining 610 when lateral insert 157 is inserted within upper 102. In some cases, second side portion 672 may be disposed adjacent to inner lining 620. In embodiments without inner lining 620, however, second side portion 672 may be configured to contact a foot directly when a foot is inserted with upper 102.

An insert system can include provisions to facilitate the coupling between a side portion of an upper and an insert. This may allow a side portion and an insert to present a substantially continuous outer surface for an upper. In some embodiments, raised portions of an insert may engage apertures of a side portion to facilitate the coupling between a side portion of the upper and an insert.

As previously discussed, raised portions can be configured with varying heights. In some embodiments, raised portions may be configured with a height to protrude through apertures. This arrangement can allow raised portions to be inserted through an aperture and exposed on an outer portion of an upper.

For example, in one embodiment, third raised portion 167 of medial insert 156 may protrude through third aperture 137 of medial side portion 106. Similarly, third raised portion 177 of lateral insert 157 may protrude through third aperture 127 of lateral side portion 107. This arrangement allows third raised portion 167 and third raised portion 177 to be exposed on outer portion 612. In some cases, this arrangement can help maintain the alignment between medial insert 156 and medial side portion 106 as well as the alignment between lateral insert 157 and lateral side portion 107.

In an exemplary embodiment, third raised portion 167 of medial insert 156 and third raised portion 177 of lateral insert 157 may be relatively flush with outer portion 612 of outer lining 610. This arrangement allows medial insert 156 and lateral insert 157 to present a substantially continuous outer surface with outer portion 612 of outer lining 610. In particular, medial insert 156 and outer portion 612 may present a substantially continuous outer surface as indicated by first dotted line L1. Likewise, lateral insert 157 and outer portion 612 can present a substantially continuous outer surface as indicated by second dotted line L2. With this arrangement, medial insert 156 and medial side portion 106 may act as a single reinforced side portion for upper 102. Similarly, lateral insert 157 and lateral side portion 107 may act as a single reinforced side portion for upper 102.

An insert system can increase the utility of an article by allowing a user to introduce and remove inserts to adjust properties of the article. For example, during activities that require more support, inserts can be introduced to the article. Likewise, inserts may be removed from the article when a user wants more flexibility. In addition, inserts can be introduced or removed from an article to adjust the breathability of the article. In cases where a user wants more insulation for the article, the user can introduce inserts to the article. Similarly, a user can remove the inserts to increase the airflow within the article.

In embodiments of an article that include apertures, an article may feel like a lightweight article or a sandal when worn without the inserts. With the inserts, the article may feel more like a traditional article of footwear with a solid upper. This arrangement allows properties of a single article to be adjusted to increase the utility of the article.

In embodiments including apertures, an article can include provisions to protect sides of a foot when an insert is not used. In some embodiments, apertures may be covered to protect a foot when an insert is not used. By covering apertures, objects or debris may be prevented from entering the apertures. In some cases, a mesh portion may cover apertures of an upper. With this arrangement, the breathability and lightweight nature of a side portion with apertures may be maintained.

Figure 7:
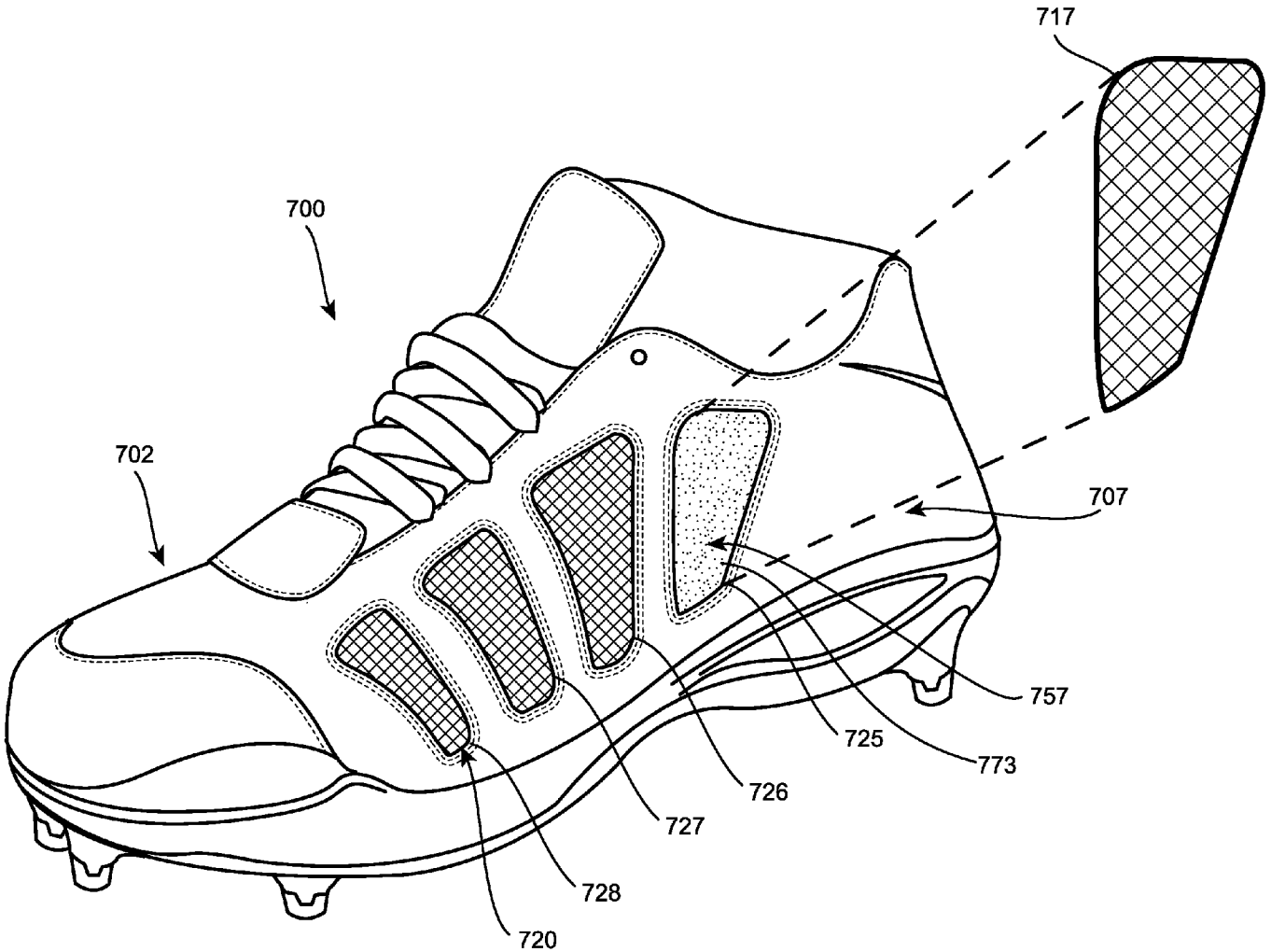
FIG. 7 is an isometric view of an exemplary embodiment of an article with covered apertures and a lateral insert with an exploded view of the lateral insert disposed beneath covered apertures.

FIG. 7 illustrates an isometric view of an exemplary embodiment of article 700. In one embodiment, article 700 may be configured in a substantially similar manner as article 100 of the previous embodiment. In particular, article 700 may include plurality of apertures 720. Plurality of apertures 720 may be disposed on lateral side portion 707 of upper 702 of article 700. In some cases, plurality of apertures 720 may include first aperture 725, second aperture 726, third aperture 727 and fourth aperture 728.

In an exemplary embodiment, upper 702 of article 700 may include mesh portion 717. In some embodiments, mesh portion 717 may cover one aperture of plurality of apertures 720. In other embodiments, mesh portion 717 may cover a combination of apertures of plurality of apertures 720. In still other embodiments, mesh portion 717 may cover plurality of apertures 720.

Generally, mesh portion 717 may be constructed from any type of material suitable for covering plurality of apertures 720. Examples of materials can include, but are not limited to: nylon, textiles, as well as any suitable knitted, woven or non-woven material. In one embodiment, mesh portion 717 may be constructed from a lightweight material. This allows mesh portion 717 to maintain the breathability provided by plurality of apertures 720 and light weight nature of lateral side portion 707. Using this arrangement, mesh portion 717 may protect a foot disposed within upper 702.

In some embodiments, mesh portion 717 may be relatively elastic. This may allow mesh portion 717 to expand outward when an insert is introduced to upper 702. For example, lateral insert 757 with plurality of raised portions 773 may be inserted within upper 702, as illustrated in an exploded view in FIG. 7. With lateral insert 757 disposed adjacent to lateral side portion 707, plurality of raised portions 773 may protrude through plurality of apertures 720. With a relatively elastic material, mesh portion 717 may expand outward to accommodate plurality of raised portions 773. Using this arrangement, plurality of apertures 720, covered by mesh portion 717, may receive and engage plurality of raised portions 773.

An insert system can include provisions to accommodate user preferences. In some embodiments, an insert system can include a plurality of inserts that may be associated with side portions of an upper. The plurality of inserts can be configured to adjust properties of a side portion in different manners. For example, an insert system can include a plurality of inserts configured with various sizes and shapes. This arrangement allows a user to select an insert to accommodate desired levels of support for different types of activities.

Figure 8:
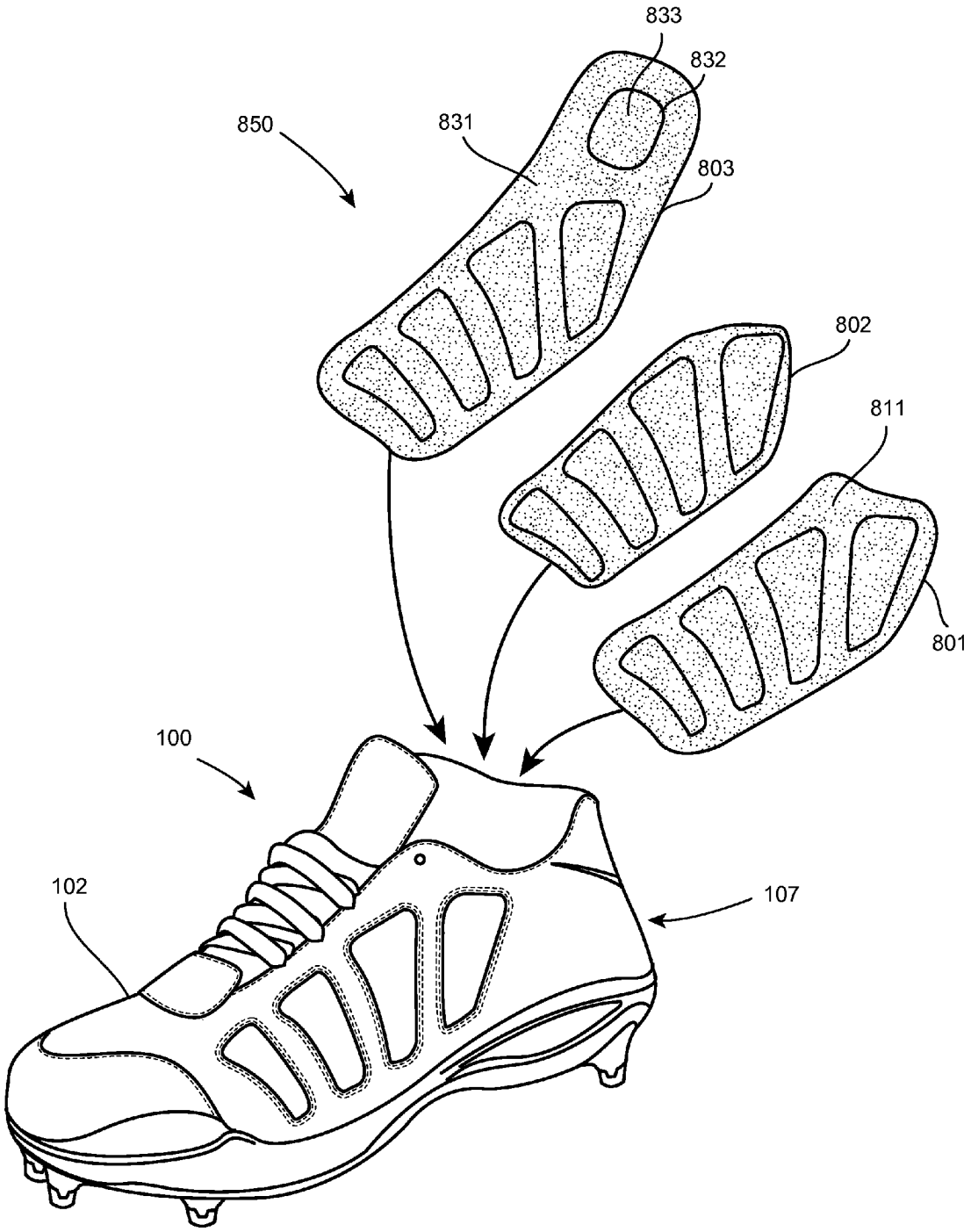
FIG. 8 is an isometric view of an exemplary embodiment of an article and an insert system including a plurality of inserts.
Figure 9:
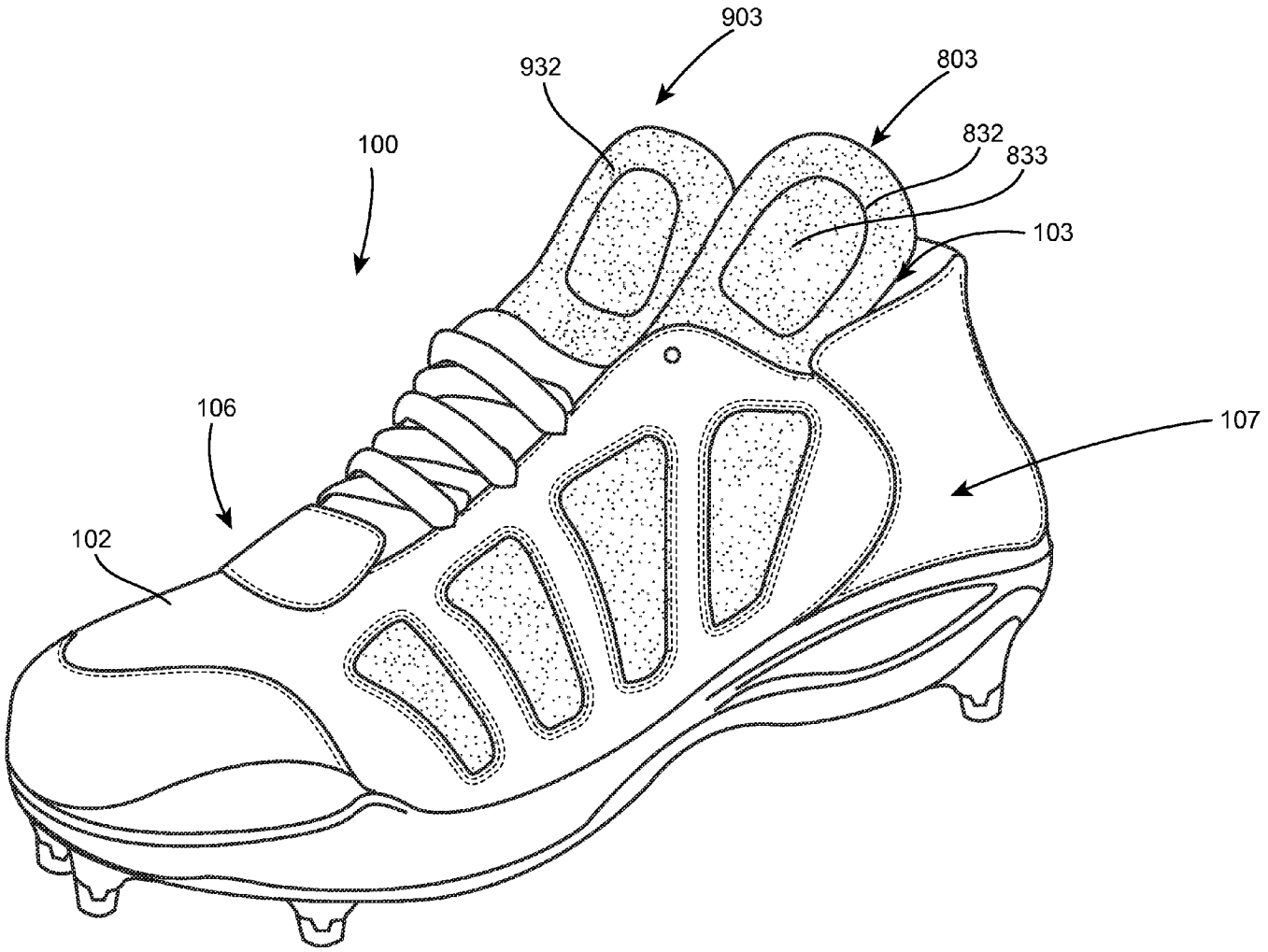
FIG. 9 is an isometric view of an exemplary embodiment of an article with an insert configured to support an ankle.

Referring to FIGS. 8 and 9, insert system 850 may be associated with upper 102 of article 100. In particular, insert system 850 may be associated with lateral side portion 107. Generally, insert system 850 can include any number of inserts. In one embodiment, insert system 850 may comprise first insert 801, second insert 802 and third insert 803.

In different embodiments, inserts of insert system 850 may be configured with different shapes and sizes to accommodate user preferences. In one embodiment, first insert 801 may be configured to provide substantial support for lateral side portion 107. In particular, first insert 801 may include extended peripheral portion 811. Extended peripheral portion 811 may be shaped to extend over a substantial portion of lateral side portion 107. This arrangement can allow first insert 801 to provide increased support to lateral side portion 107. With this arrangement, first insert 801 may be used with article 100 during a soccer or football game to provide support to lateral side portion 107.

In some embodiments, second insert 802 may be a low-profile insert. As a low-profile insert, second insert 802 may be configured with less overall surface area than first insert 801. In particular, second insert 802 may not be configured with an extended peripheral portion as first insert 801. Furthermore, second insert 802 may have less pronounced corners than first insert 801. This configuration allows second insert 802 to provide some reinforcement for lateral side portion 107 without stiffening the entire side wall of lateral side portion 107. With this configuration, second insert 802 may be useful during activities such as cross training or running because second insert 802 provides some support while maintaining flexibility of lateral side portion 107.

Third insert 803 of insert system 850 may be configured to provide support to an ankle portion of a foot. In some embodiments, third insert 803 may include ankle portion 832. Ankle portion 832 may be disposed adjacent to extended peripheral portion 831 of third insert 803. This arrangement allows third insert 803 to cover a substantial portion of lateral side portion 107 as well as protect an ankle portion of a foot. With this arrangement, third insert 803 can be used during any activities that require increased ankle support.

In some embodiments, ankle portion 832 may include ankle pad 833. Ankle pad 833 may be configured to provide additional protection to an ankle portion of a foot. In some cases, ankle pad 833 may be associated with a bony protrusion of an ankle. For example, ankle pad 833 may be configured to protect a portion of a tibia, fibulas or talus.

Referring to FIG. 9, third insert 803 is inserted into upper 102 and disposed adjacent to lateral side portion 107. In addition, medial insert 903 may be inserted within upper 102 and disposed adjacent to medial side portion 106. In some embodiments, medial insert 903 may be configured in a substantially similar manner as third insert 803. In particular, medial insert 903 may include medial ankle portion 932.

In embodiments where third insert 803 and medial insert 903 are associated with a high top upper, third insert 803 and medial insert 903 may be disposed within the high top upper. In embodiments where third insert 803 and medial insert 903 are associated with a low top upper, third insert 803 and medial insert 903 may extend above the upper. In an exemplary embodiment, ankle portion 832 and medial ankle portion 932 extend from throat 103 of upper 102. With this arrangement, third insert 803 and medial insert 903 may protect and provide increased support to an ankle portion of a foot.

With an insert system comprising different types of inserts, a user can select an insert to accommodate desired levels of support for different types of activities. The interchangeability of the inserts allows a user to remove one insert from an article and replace it with a different insert that may be configured to provide a different level of support. Using this arrangement, a user can fine tune the properties of a single article of footwear with an insert system.

An insert system can include provisions to accommodate differences between a medial side portion and a lateral side portion of a foot. Since a foot is not typically symmetrical, an insert associated with a medial side portion of a foot may be shaped differently than an insert associated with a lateral side portion of a foot. In some cases, an insert associated with a lateral side portion of a foot may be configured with greater surface area to accommodate the greater surface area of a lateral side portion of a foot.

FIG. 10 illustrates a top down view of an exemplary embodiment of article 1000. Generally, article 1000 may be any type of article. Furthermore, article 1000 includes upper 1002. Upper 1002 may include medial side portion 1006 and lateral side portion 1007.

In some embodiments, article 1000 may be associated with insert system 1050. Insert system 1050 may comprise medial insert 1056 and lateral insert 1057. In some cases, medial insert 1056 and lateral insert 1057 may have substantially different shapes to accommodate differences between a medial side portion and a lateral side portion of a foot.

In an exemplary embodiment, lateral insert 1057 includes first peripheral portion 1070. Likewise, medial insert 1056 includes second peripheral portion 1060. In some embodiments, first peripheral portion 1070 may be configured with a greater surface area than second peripheral portion 1060. In one embodiment, first peripheral portion 1070 may extend higher on upper portion 1072 of lateral insert 1057 than second peripheral portion 1060 extends on upper portion 1062 of medial insert 1056. With this arrangement, lateral insert 1057 and medial insert 1056 can accommodate the differences in the shapes of a lateral portion and medial portion of a foot.

In some embodiments, a medial insert and a lateral insert may be further modified to accommodate additional differences between sides of a foot. In addition, a medial insert and a lateral insert may be configured to accommodate different functions of sides of a foot during some types of activities. For example, in cases where a medial portion of a foot is used to kick a ball, a medial insert may be configured with greater rigidity than a lateral insert.

In some cases, inserts may be custom tailored to accommodate different shapes of feet. In other cases, inserts could be manufactured in pre-selected shapes that correspond to common differences in feet. This arrangement can increase the comfort and usability of inserts.

An insert system can include provisions to accommodate common variable characteristics of feet. For example, widths of feet commonly vary. In some embodiments, a set of inserts may be configured so that each insert of the set of inserts has a different thickness that can be used to modify the interior width of an upper. For example, a thinner insert may accommodate a wider foot by providing a greater interior width of an upper. Likewise, a thicker insert may accommodate a thinner foot by providing a smaller interior width of an upper. This arrangement can increase the comfort and usability of inserts.

Figures 11, 12, 13:
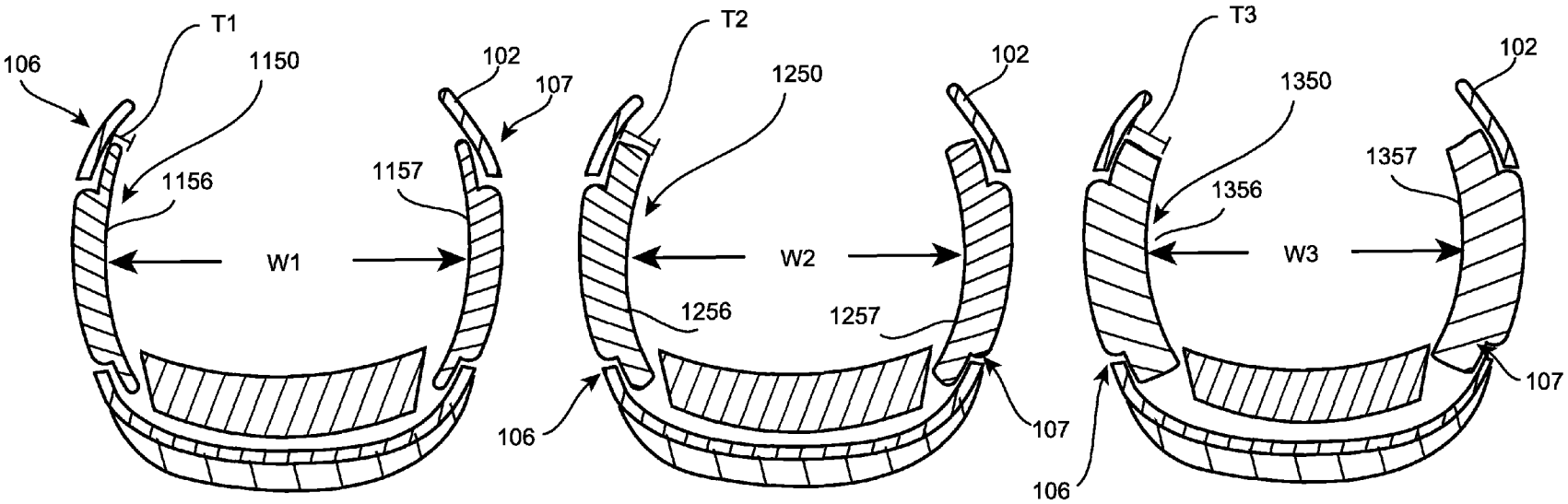
FIG. 11 is a schematic cross sectional view of an exemplary embodiment of an article of footwear with a medial and lateral insert.
FIG. 12 is a schematic cross sectional view of an exemplary embodiment of an article of footwear with a medial and lateral insert.
FIG. 13 is a schematic cross sectional view of an exemplary embodiment of an article of footwear with a medial and lateral insert.

FIGS. 11-13 illustrate cross sectional views of exemplary embodiments of article 100 associated with a set of inserts systems. The cross sectional views of these Figures are similar to the view discussed with respect to FIG. 6. Furthermore, in FIGS. 11-13, article 100 may be associated with a medial insert and a lateral insert. For purposes of clarity, the medial insert and the lateral insert may be configured in a substantially similar manner. In particular, the medial insert and lateral insert may be configured with substantially similar thicknesses. In other embodiments, however, a medial insert and a lateral insert may be configured with different thicknesses.

Referring to FIG. 11, article 100 is associated with first insert system 1150. First insert system 1150 may comprise medial insert 1156 and lateral insert 1157. In one embodiment, medial insert 1156 and lateral insert 1157 may be configured with first thickness T1. With first thickness T1 of medial insert 1156 and lateral insert 1157, upper 102 may have first interior width W1.

In some embodiments, second insert system 1250 may be inserted within article 100, as illustrated in FIG. 12. In particular, medial insert 1256 and lateral insert 1257 may be associated with medial side portion 106 and lateral side portion 107, respectively. In an exemplary embodiment, medial insert 1256 and lateral insert 1257 may be configured with second thickness T2. Second thickness T2 may be greater than first thickness T1 of the previous embodiment. This configuration provides upper 102 with second interior width W2. Second interior width W2 may be narrower than first interior width W1 of the previous embodiment due to the greater second thickness T2 of second insert system 1250. With this arrangement, second insert system 1250 may accommodate a narrower foot than first insert system 1150.

Referring to FIG. 13, article 100 may be associated with third insert system 1350. Third insert system 1350 may include medial insert 1356 and lateral insert 1357. Furthermore, medial insert 1356 and lateral insert 1357 may be associated with third thickness T3. Third thickness T3 may be thicker than second thickness T2. This arrangement provides upper 102 with third interior width W3. Third interior width W3 may be narrower than second interior width W2 of the previous embodiment illustrated in FIG. 12. Using this arrangement, third insert system 1350 may accommodate a narrower foot than second insert system 1250 and first insert system 1150, as illustrated in FIGS. 11 and 12.

An article can include provisions to secure an insert to an upper. In different embodiments, an insert may be positioned and secured to a side portion of an upper by different methods. In some embodiments, an insert may be inserted within a pocket associated with an upper. In other embodiments, an insert may be secured to a side portion of an upper with a fastening system. In still other embodiments, an insert may be secured to a side portion through locating features. It is also possible that provisions to secure an insert to an upper can help maintain the alignment between the insert and the side portion during use of the article.

Figure 14:
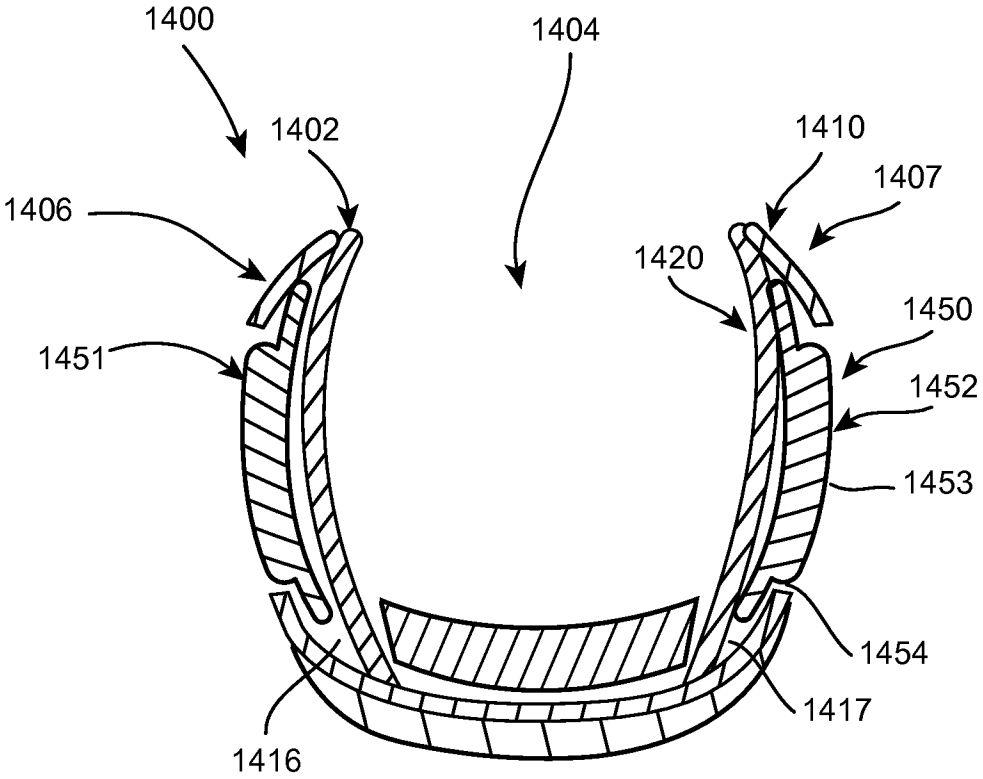
FIG. 14 is a schematic cross sectional view of an exemplary embodiment of an attachment of a medial and lateral insert to an article of footwear.
Figure 16:
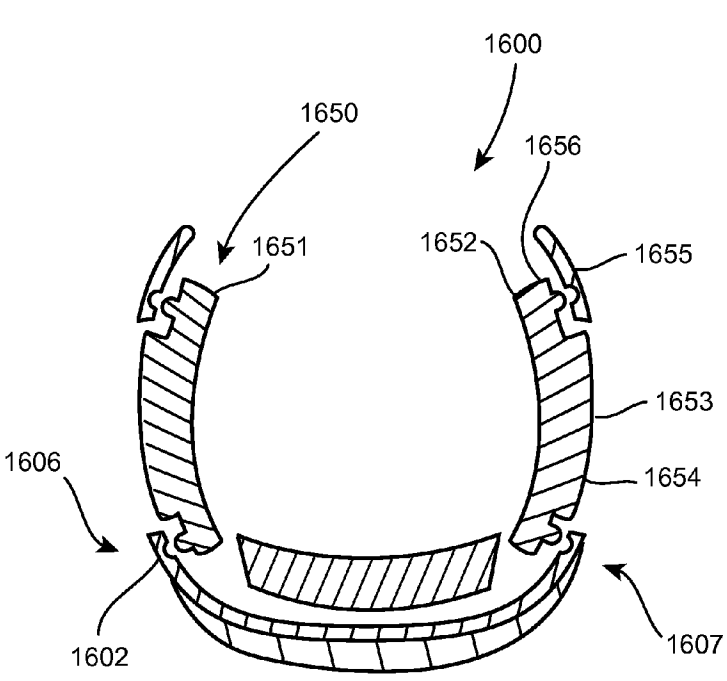
FIG. 16 is a schematic cross sectional view of an exemplary embodiment of an attachment of a medial and lateral insert to an article of footwear.
Figure 15:
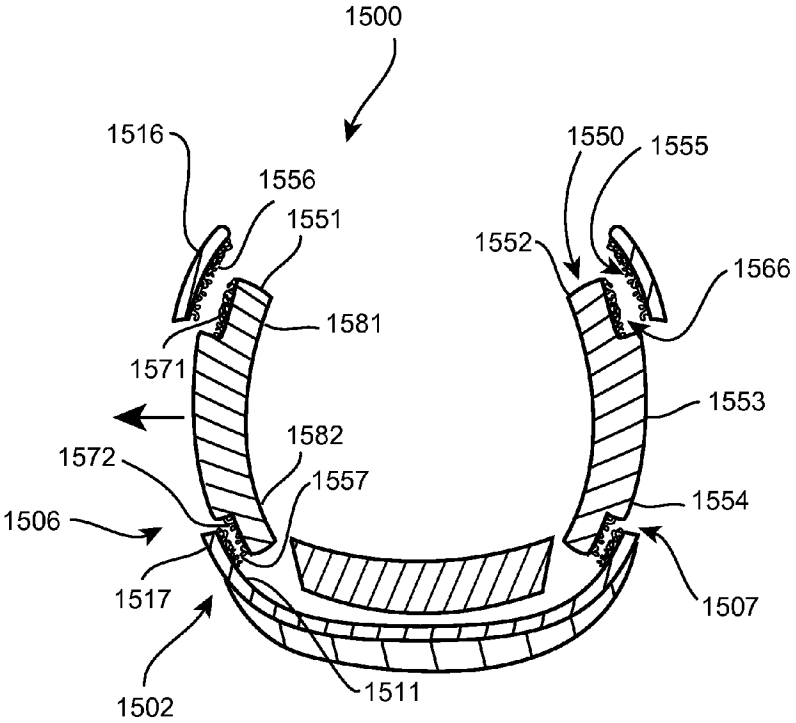
FIG. 15 is a schematic cross sectional view of an exemplary embodiment of an attachment of a medial and lateral insert to an article of footwear.

FIGS. 14-16 illustrate cross sectional views of exemplary embodiments of articles with various provisions to secure an insert. The cross sectional views of these Figures are similar to the view discussed with respect to FIG. 6. Furthermore, in FIGS. 14-16, articles may be associated with insert systems that comprise a medial insert and a lateral insert. For purposes of clarity, the medial insert and the lateral insert of each insert system may be configured to secure to the articles in a substantially similar manner.

Generally, an insert may be inserted into an upper through various openings of the upper. In some embodiments, an insert may be inserted through a throat of the upper. In other embodiments, an insert may be inserted through a fastening system of the upper. For example, in embodiments including a lacing portion, laces may be unfastened to introduce an insert through the lacing portion. For purposes of clarity, FIGS. 14-16 illustrate an insert inserted through a lacing portion of an upper without laces.

Referring to FIG. 14, insert system 1450 may be inserted within pockets associated with upper 1402 of article 1400. In different embodiments, pockets may be formed in various manners. In some embodiments, pockets may be associated with a liner that may be introduced into upper 1402 of article 1400. In other embodiments, pockets may be formed within upper 1402.

In some embodiments, a pair of pockets may be formed by portions of upper 1402 of article 1400. In some cases, a pair of pockets may be formed by inner lining 1420 and outer lining 1410 of upper 1402. Inner lining 1420 may be associated with interior cavity 1404 of upper 1402. Outer lining 1410 may be disposed opposite inner lining 1420. With this arrangement, inner lining 1420 may be spaced apart from outer lining 1410 to form a pair of pockets to receive a pair of inserts. In particular, inner lining 1420 and outer lining 1410 may form medial pocket 1416 and lateral pocket 1417 disposed on medial side portion 1406 and lateral side portion 1407 of upper 1402, respectively.

In different embodiments, an insert may be inserted within a pocket in different manners. In some embodiments, an insert may be inserted within an opening of a pocket disposed adjacent to a throat of an article. In other embodiments, an insert may be inserted within an opening of a pocket disposed adjacent to a fastening portion of an article. In still other embodiments, an insert may be inserted within an opening of a pocket disposed on a side portion of an upper.

In an exemplary embodiment, upper 1402 includes plurality of apertures 1454 disposed on medial side portion 1406 and lateral side portion 1407. Furthermore, insert system 1450 may include plurality of raised portions 1453. Plurality of raised portions 1453 may be disposed on first insert 1451 and second insert 1452 of insert system 1450. With this arrangement, plurality of apertures 1454 and plurality of raised portions 1453 may assist in aligning first insert 1451 and second insert 1452 with medial side portion 1406 and lateral side portion 1407, respectively.

In one embodiment, first insert 1451 and second insert 1452 may be inserted into medial pocket 1416 and lateral pocket 1417, respectively. With this arrangement, first insert 1451 and second insert 1452 may be disposed between inner lining 1420 and outer lining 1410. After inserting first insert 1451 and second insert 1452, first insert 1451 and second insert 1452 may be positioned longitudinally along medial side portion 1406 and lateral side portion 1407, respectively. In embodiments with plurality of apertures 1454, first insert 1451 and second insert 1452 may be positioned so that plurality of apertures 1454 engage plurality of raised portions 1453. Using this arrangement, first insert 1451 and second insert 1452 may be secured to medial side portion 1406 and lateral side portion 1407, respectively.

In other embodiments, an upper may be configured with a fastening system to secure an insert to the upper. Referring to FIG. 15, upper 1502 of article 1500 includes plurality of fastener receiving portions 1555. Plurality of fastener receiving portions 1555 may be configured to fasten a pair of inserts to upper 1502.

In different embodiments, plurality of fastener receiving portions 1555 may be disposed in different locations on upper 1502 to fasten a pair of inserts to upper 1502. In some embodiments, plurality of fastener receiving portions 1555 may be disposed on medial side portion 1506 and lateral side portion 1507 of upper 1502. In some cases, plurality of fastener receiving portions 1555 may be disposed adjacent to a bottom portion of medial side portion 1506 and lateral side portion 1507. In other cases, plurality of fastener receiving portions 1555 may be disposed adjacent to a top portion of medial side portion 1506 and lateral side portion 1507. In one embodiment, plurality of fastener receiving portions 1555 may be disposed adjacent to a bottom portion and top portion of medial side portion 1506 and lateral side portion 1507.

In an exemplary embodiment, plurality of fastener receiving portions 1555 may be disposed above and below plurality of apertures 1554 of upper 1502. In particular, plurality of fastener receiving portions 1555 may be disposed on inner portion 1511 of medial side portion 1506 and lateral side portion 1507.

In one embodiment, plurality of fastener receiving portions 1555 includes first fastener receiving portion 1556 and second fastener receiving portion 1557 disposed on medial side portion 1506. First fastener receiving portion 1556 may be disposed on first portion 1516 of medial side portion 1506. First portion 1516 may be disposed above plurality of apertures 1554. Similarly, second fastener receiving portion 1557 may be disposed on second portion 1517 of medial side portion 1506. Second portion 1517 may be disposed below plurality of apertures 1554. Furthermore, plurality of fastener receiving portions 1555 may include fastener receiving portions arranged in a substantially similar manner on lateral side portion 1507. With this arrangement, plurality of fastener receiving portions 1555 may fasten a pair of inserts.

Generally, various fastening systems may be used to fasten an insert to an upper. Examples of fastening systems include, but are not limited to: laces, straps, zippers, hook and loop fasteners, snap fasteners, as well as other types of fastening systems. In one embodiment, plurality of fastener receiving portions 1555 comprises loop portions of a hook and loop type fastener.

In some embodiments, insert system 1550 may be associated with article 1500. Insert system 1550 includes first insert 1551 and second insert 1552. In some cases, first insert 1551 and second insert 1552 may include plurality of raised portions 1553.

In an exemplary embodiment, first insert 1551 and second insert 1552 may be configured with plurality of fasteners 1566. Plurality of fasteners may be configured to associate with fastener receiving portions disposed on upper 1502. In some cases, plurality of fasteners 1556 may comprise hook portions of a hook and loop type fastener to associate with plurality of fastener receiving portions 1555.

In some embodiments, plurality of fasteners 1566 may be disposed above and below plurality of raised portions 1553. Plurality of fasteners 1566 may include first fastener 1571 and second fasteners 1572 disposed on first insert 1551. First fastener 1571 may be disposed on first portion 1581 of first insert 1551. In some cases, first portion 1581 may be disposed on a peripheral portion above plurality of raised portions 1553. Similarly, second fastener 1572 may be disposed on second portion 1582 of first insert 1551. Second portion 1582 may be disposed on a peripheral portion below plurality of raised portions 1553. Furthermore, plurality of fasteners 1566 may also include fasteners disposed on second insert 1552 in a substantially similar manner as first insert 1551.

In one embodiment, first insert 1551 may be inserted within upper 1502 and positioned adjacent to medial side portion 1506. In particular, first insert 1551 may be aligned with medial side portion 1506 so that plurality of apertures 1554 engage plurality of raised portions 1553. Furthermore, plurality of fasteners 1566 may be aligned with and secured to plurality of fastener receiving portions 1555. In particular, first fastener receiving portion 1556 may fasten to first fastener 1571. Also, second fastener receiving portion 1557 may fasten to second fastener 1572. With this arrangement, first insert 1551 may be secured to medial side portion 1506 of upper 1502.

In a similar manner, second insert 1552 may be inserted within upper 1502. Following insertion, second insert 1552 may be aligned with lateral side portion 1507 so that plurality of apertures 1554 engage plurality of raised portions 1553. In addition, plurality of fasteners 1566 may be aligned with and secured to plurality of fastener receiving portions 1555. With this arrangement, second insert 1552 may be fastened to lateral side portion 1507 of article 1502.

In other embodiments, an insert may be configured with a plurality of first locating features that may engage a plurality of second locating features on an upper to facilitate alignment of an upper. In some cases, friction may assist in securing the insert to the upper after the insert is aligned with side portions of an upper.

Referring to FIG. 16, insert system 1650 may be associated with article 1600. Insert system 1650 includes first insert 1651 and second insert 1652. In some embodiments, first insert 1651 and second insert 1652 may include plurality of first locating features 1656. Plurality of first locating features 1656 may be disposed above and below plurality of raised portions 1653 of first insert 1651 and second insert 1652. Using this configuration, plurality of first locating features 1656 may be configured to facilitate the alignment of first insert 1651 and second insert 1652.

In some embodiments, upper 1602 includes plurality of second locating features 1655. Plurality of second locating features 1655 may be disposed on medial side portion 1606 and lateral side portion 1607 of upper 1602. Plurality of second locating features 1655 may be configured to receive plurality of first locating features 1656. This arrangement may facilitate an alignment of insert system 1650 with medial side portion 1606 and lateral side portion 1607.

In different embodiments, plurality of second locating features 1655 may be disposed in various locations on medial side portion 1606 and lateral side portion 1607. In one embodiment, plurality of second locating features 1655 may be disposed above and below plurality of apertures 1654 of upper 1602. With this arrangement, plurality of second locating features 1655 may assist in the alignment of inserts with medial side portion 1606 and lateral side portions 1607.

Generally, locating features may be configured with various sizes and shapes. Examples of shapes include, but are not limited to: square shapes, rectangular shapes, elliptical shapes, triangular shapes, regular shapes, irregular shapes as well as other types of shapes. In an exemplary embodiment, plurality of first locating features 1656 and plurality of second locating features 1655 are configured with rounded shapes. In particular, plurality of first locating features 1656 may be configured with rounded shapes that protrude from first insert 1651 and second insert 1652. In contrast, plurality of second locating features 1655 may be configured with rounded shapes that are recessed within upper 1602. With this arrangement, plurality of first locating features 1656 may engage plurality of second locating features 1655.

In different embodiments, plurality of first locating features 1656 and plurality of second locating features 1655 may be configured with various heights and depths, respectively. By varying the height and depth of plurality of first locating features 1656 and plurality of second locating features 1655, respectively, the strength of the engagement between plurality of first locating features 1656 and plurality of second locating features 1655 may be adjusted.

In an exemplary embodiment, first insert 1651 may be inserted within upper 1602 and associated with medial side portion 1606. In particular, first insert 1651 may be aligned with medial side portion 1606 so that plurality of apertures 1654 engage plurality of raised portions 1653. Furthermore, plurality of first locating features 1656 may be aligned with and engage plurality of second locating features 1655. With this arrangement, first insert 1651 may be aligned and associated with medial side portion 1606 of upper 1602.

Similarly, second insert 1652 may be inserted within upper 1602. Following insertion, second insert 1652 may be aligned with lateral side portion 1607 so that plurality of apertures 1654 engage plurality of raised portions 1653. In addition, plurality of first locating features 1656 may be aligned with and engage plurality of second locating features 1655. With this arrangement, second insert 1652 may be associated with lateral side portion 1607 of article 1602.

In some embodiments, an article can be configured with multiple provisions for aligning and securing an insert to a side portion of an upper. For example, an upper may be configured with a plurality of locating features as well as fastener receiving portions to secure an insert. In some cases, the plurality of locating features may assist in aligning and positioning an insert on a side portion of an upper while the fastener receiving portions secure the insert to a side portion of an upper.

Figure 17:
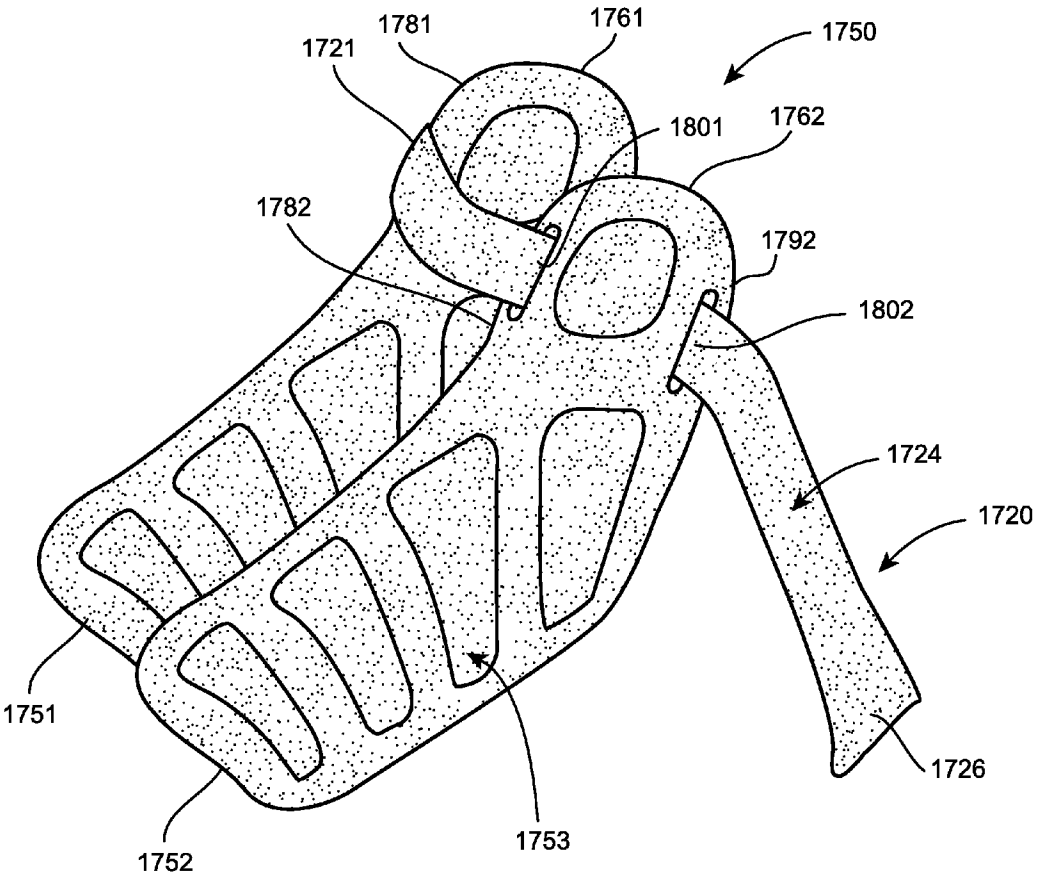
FIG. 17 is an isometric view of an exemplary embodiment of an insert system that includes an ankle strap and is configured to support an ankle.

Referring to FIG. 17, insert system 1750 includes medial insert 1751 and lateral insert 1752. Medial insert 1751 and lateral insert 1752 are configured to be inserted into an upper of an article. In some embodiments, medial insert 1751 and lateral insert 1752 may provide support to an ankle of a foot disposed within an upper. In particular, medial insert 1751 and lateral insert 1752 are configured with medial ankle portion 1761 and lateral ankle portion 1762, respectively. Medial ankle portion 1761 and lateral ankle portion 1762 may be disposed adjacent to an ankle portion of a foot when insert system 1750 is used with an article.

Generally, medial insert 1751 and lateral insert 1752 may be configured with any combination of provisions discussed with respect to previous embodiments. For example, in some embodiments, medial insert 1751 and lateral insert 1752 may be shaped differently to accommodate the different shapes of a lateral and medial portion of a foot. In other embodiments, medial insert 1751 and lateral insert 1752 may be configured with various thicknesses to accommodate a width of a foot disposed within an upper. In one embodiment, medial insert 1751 and lateral insert 1752 may be configured with plurality of raised portions 1753.

An insert system can include provisions to increase support for an ankle. In some embodiments, an ankle strap may provide support to an ankle by securing an insert system and an upper to the ankle. In some cases, an ankle strap may be fixedly attached to a pair of inserts of an insert system. In other cases, an ankle strap can be fixedly attached to one insert of an insert system. In an exemplary embodiment, an ankle strap may be fixedly attached to a first insert of an insert system and releasably attached to a second insert of the insert system. With this arrangement, the ankle strap may be configured to tighten an ankle portion of an article to provide support to an ankle.

Insert system 1750 may include ankle strap 1720. In some embodiments, ankle strap 1720 may be fixedly attached to one insert of insert system 1750. For example, ankle strap 1720 may be fixedly attached to medial insert 1751. In addition, ankle strap 1720 may be releasably attached to lateral insert 1752.

In different embodiments, ankle strap 1720 may be releasably attached to lateral insert 1752 in various manners known in the art. In some embodiments, lateral insert 1752 may include a plurality of openings to receive ankle strap 1720. In an exemplary embodiment, lateral insert 1752 includes first slot 1801 and second slot 1802. First slot 1801 and second slot 1802 can be configured to receive ankle strap 1720. In other words, ankle strap 1720 may be threaded through first slot 1801 and second slot 1802 of lateral insert 1752. With this arrangement, ankle strap 1720 may allow lateral insert 1752 to move relative to medial insert 1751 while connecting lateral insert 1752 to medial insert 1751.

In different embodiments, ankle strap 1720 may extend between different portions of medial insert 1751 and lateral insert 1752. In one embodiment, first end portion 1721 of ankle strap 1720 may be fixedly connected to first forward portion 1781 of medial ankle portion 1761. First forward portion 1781 may face toward a forefoot of a foot when insert system 1750 is used with an article. In a similar manner, second end portion 1726 of ankle strap 1720 may be threaded through first slot 1801. In some cases, first slot 1801 may be disposed adjacent to second forward portion 1782 of lateral ankle portion 1762. Following the insertion of second end portion 1726 in first slot 1801, second end portion 1726 may be threaded through second slot 1802. In some cases, second slot 1802 may be disposed adjacent to rearward portion 1792 of lateral ankle portion 1762. Rearward portion 1792 may face toward a heel of a foot when insert system 1750 is used with an article. With this arrangement, ankle strap 1720 may extend between medial insert 1751 and lateral insert 1752 across a forward portion of a throat when insert system 1750 is associated with an article.

Ankle strap 1720 may also be configured to tighten an upper at an ankle portion of an article. In some embodiments, a fastening portion of ankle strap 1720 may be configured to tighten an upper at an ankle portion of the article. In one embodiment, ankle strap 1720 includes fastening portion 1724. Fastening portion 1724 may extend between a portion of ankle strap 1720 disposed adjacent to second slot 1802 and second end portion 1726. Using this arrangement, fastening portion 1724 of ankle strap 1720 may be configured to tighten an upper of an article.

Figure 18:
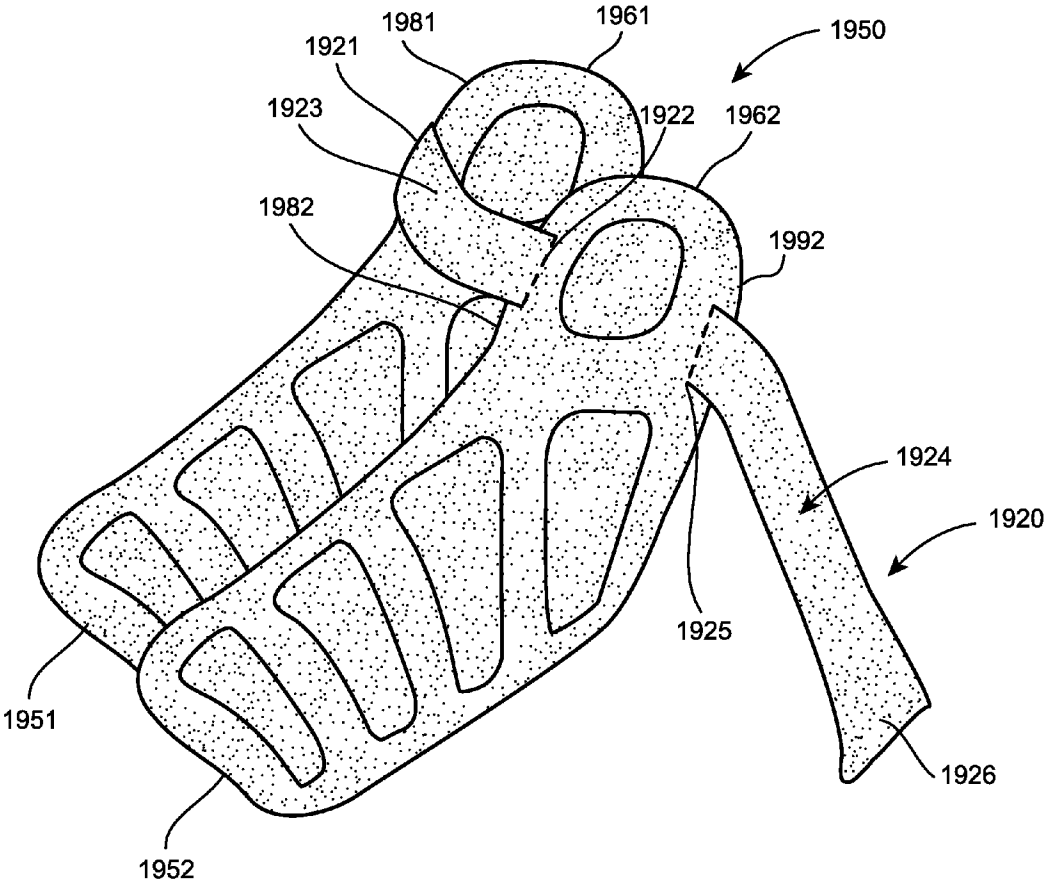
FIG. 18 is an isometric view of an alternative embodiment of an insert system that includes an ankle strap and is configured to support an ankle.

In other embodiments, however, an ankle strap may be fixedly attached to a medial insert and a lateral insert of an insert system. FIG. 18 illustrates an alternative embodiment of insert system 1950. Insert system 1950 includes medial insert 1951 and lateral insert 1952. In some cases, medial insert 1951 and lateral insert 1952 may be configured to provide support to an ankle. In particular, medial insert 1951 includes medial ankle portion 1961. Likewise, lateral insert 1952 includes lateral ankle portion 1962.

Insert system 1950 also comprises ankle strap 1920. In one embodiment, ankle strap 1920 is fixedly attached to medial insert 1951 and lateral insert 1952. In particular, connecting portion 1923 of ankle strap 1920 may extend between medial insert 1951 and lateral insert 1952. In some cases, first end portion 1921 of connecting portion 1923 may be fixedly connected to first forward portion 1981 of medial ankle portion 1961. In a similar manner, second end portion 1922 of connecting portion 1923 may be fixedly attached to second forward portion 1982 of lateral ankle portion 1962. Furthermore, intermediate portion 1925 of ankle strap 1920 may be fixedly attached to rearward portion 1992 of lateral ankle portion 1962. With this configuration, connecting portion 1923 of ankle strap 1920 may connect medial insert 1951 and lateral insert 1952 across a forward portion of a throat when insert system 1950 is associated with an article.

Ankle strap 1920 may also include fastening portion 1924 configured to tighten an upper at an ankle portion of an article. In some cases, fastening portion 1924 may be configured in a substantially similar manner to fastening portion 1724 of the previous embodiment. In particular, fastening portion 1924 may extend between intermediate portion 1925 and second end portion 1926 of ankle strap 1920. With this arrangement, fastening portion 1924 may be used to tighten an upper at an ankle portion of an article.

Generally, an ankle strap may be constructed from any suitable material. Examples of suitable materials include, but are not limited to: nylon, natural leather, synthetic leather, natural rubber or synthetic rubber, as well as knitted, woven or non-woven material. In some embodiments, portions of an ankle strap may be constructed of different materials. For example, a fastening portion may be constructed of a different material than a remaining portion of an ankle strap. In an exemplary embodiment, an ankle strap may be configured with a material with some degree of elasticity. This can allow an ankle strap to stretch between a medial insert and a lateral insert to accommodate different widths of a foot.

Figure 19:
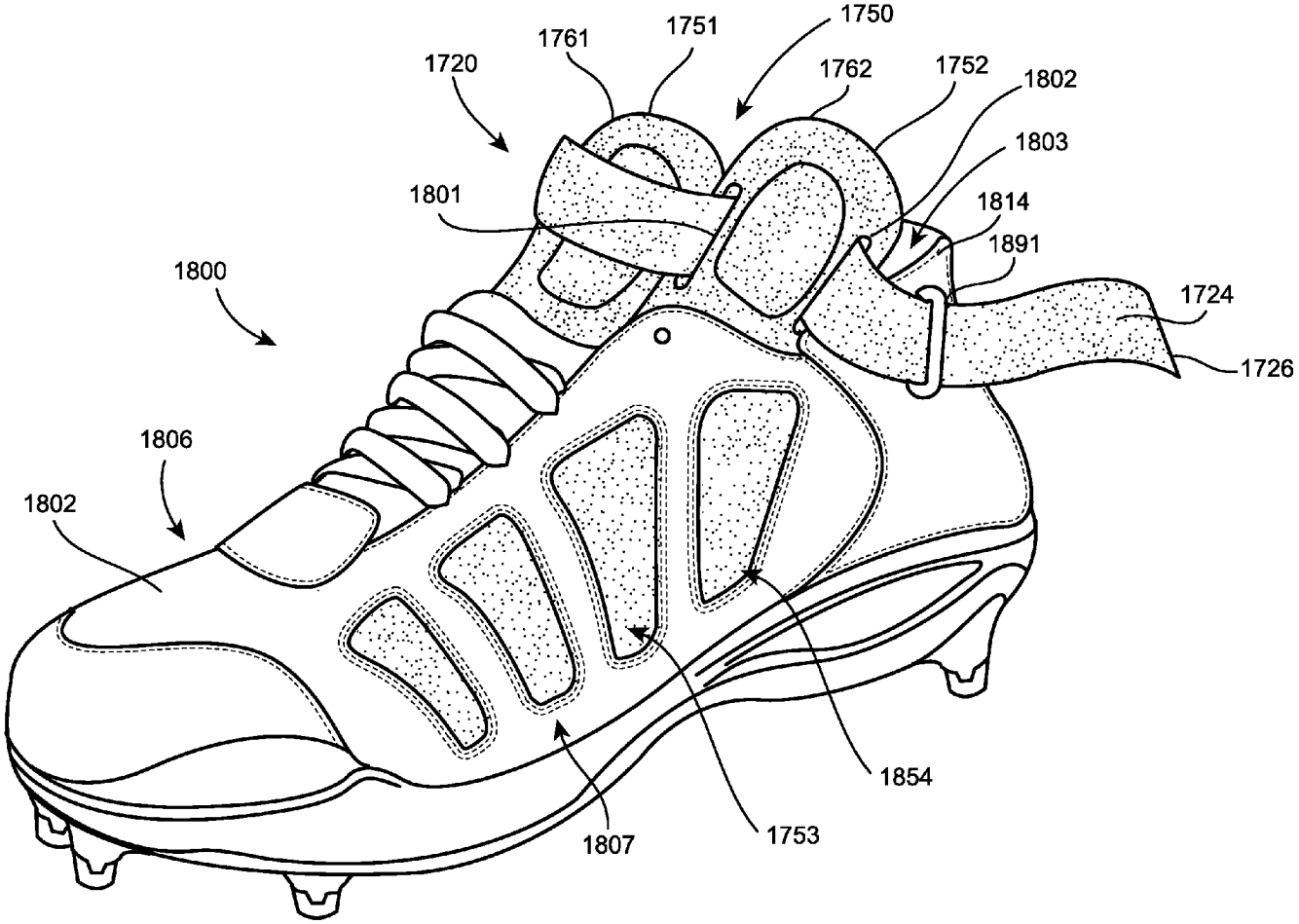
FIG. 19 is an isometric view of an exemplary embodiment of an insert system that includes an ankle strap and is configured to support an ankle inserted within an article of footwear.
Figure 20:
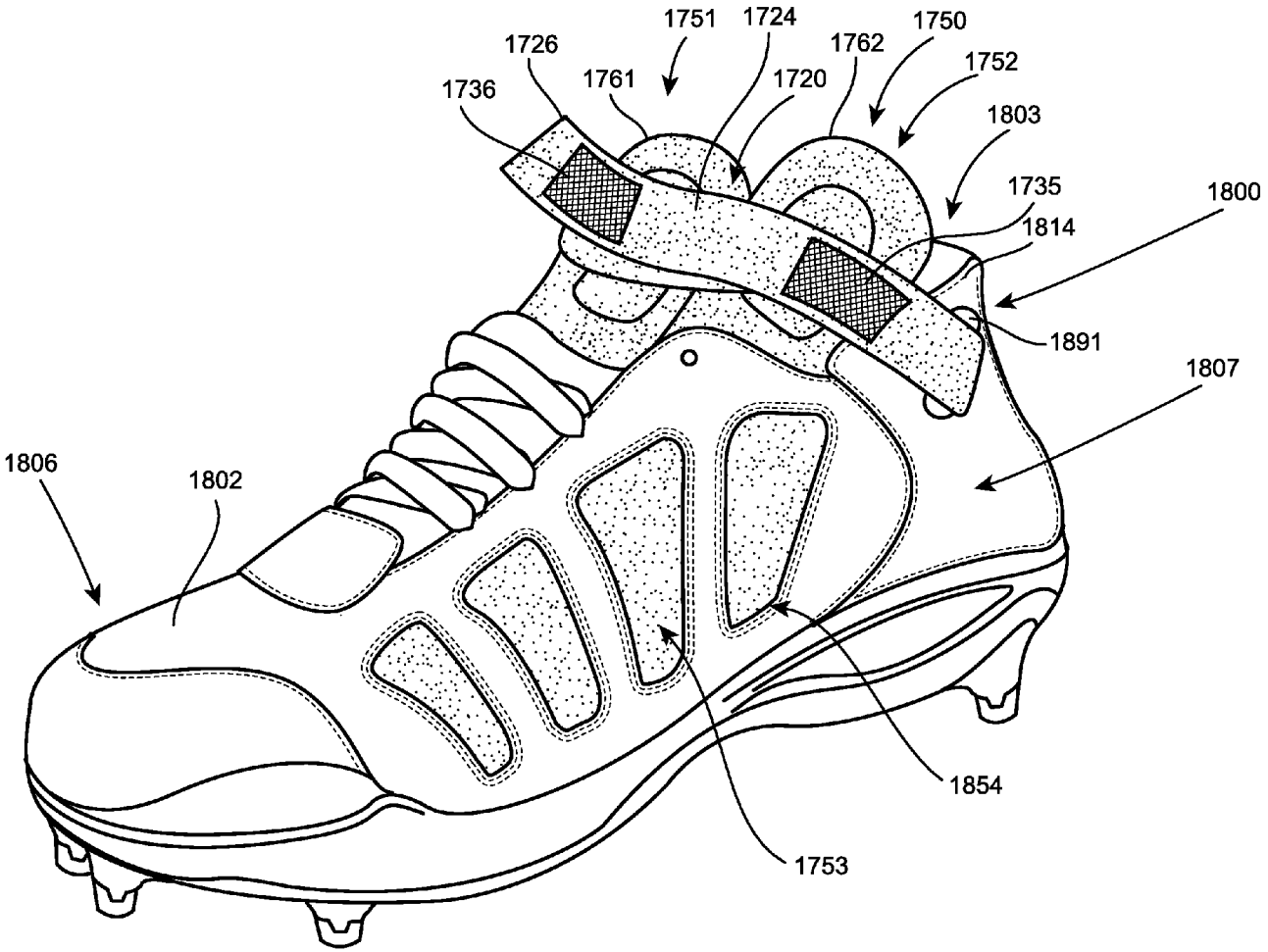
FIG. 20 is an isometric view of an exemplary embodiment of a fastening of an ankle strap of an insert system with an article of footwear.
Figure 21:
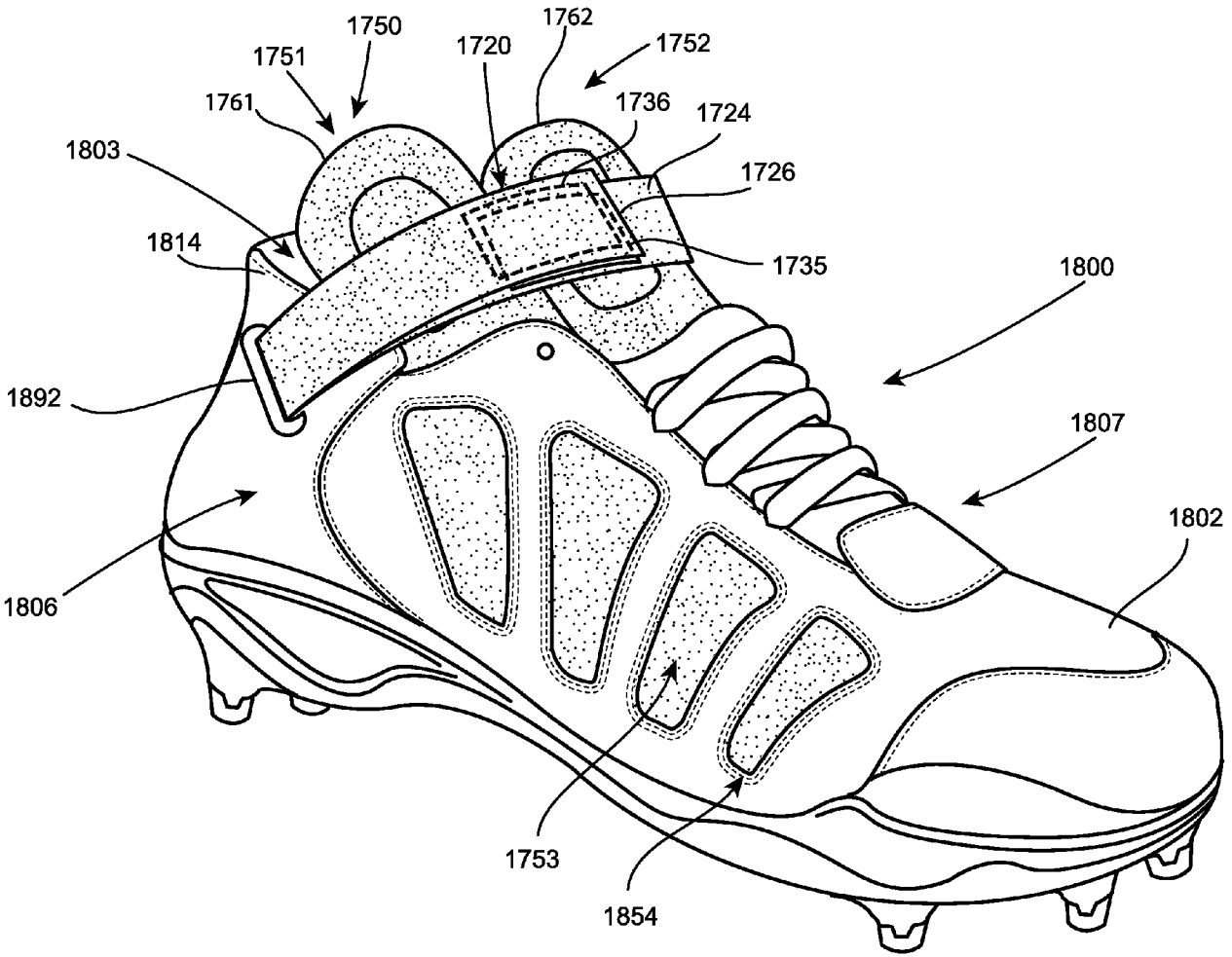
FIG. 21 is an isometric view of an exemplary embodiment of a fastening of an ankle strap of an insert system with an article of footwear.

Referring to FIGS. 19-21, insert system 1750 may be associated with upper 1802 of article of footwear 1800. In one embodiment, upper 1802 includes plurality of apertures 1854. Plurality of apertures 1854 can be disposed on medial side portion 1806 and lateral side portion 1807 of upper 1802. With this arrangement, plurality of apertures 1854 may be configured to receive plurality of raised portions 1753 of insert system 1750.

Insert system 1750 may be inserted within upper 1802 of article 1800 in various manners. In some embodiments, insert system 1750 may be inserted so that medial insert 1751 is associated with an inner portion of medial side portion 1806. Following insertion within upper 1802, medial ankle portion 1761 may extend from throat 1803 of upper 1802. In a similar manner, lateral insert 1752 may be inserted within upper 1802 so that lateral insert 1752 is disposed adjacent to an inner portion of lateral side portion 1807. As lateral insert 1752 is disposed adjacent to an inner portion of lateral side portion 1807, lateral ankle portion 1762 may extend from throat 1803 of upper 1802. Furthermore, medial insert 1751 and lateral insert 1752 may be aligned so that plurality of raised portions 1753 engage plurality of apertures 1854. Following the insertion of insert system 1750, ankle strap 1720 may be fastened to upper 1802.

In different embodiments, an upper may be configured with different provisions to fasten an ankle strap to an article. In some embodiments, an upper may be configured with apertures that may receive an ankle strap to fasten the ankle strap. In other embodiments, an upper may include one or more straps receiving portions to fasten an ankle strap to an article. In one embodiment, an upper can include one or more straps receiving portions that are D-rings.

Referring to FIGS. 19 and 20, upper 1802 includes first strap receiving portion 1891. In addition, upper 1802 includes second strap receiving portion 1892, as illustrated in FIG. 21. Generally, first strap receiving portion 1891 and second strap receiving portion 1892 may be disposed in various locations on upper 1802. In some embodiments, first strap receiving portion 1891 and second strap receiving portion 1892 may be disposed near an opening of upper 1802. In some cases, first strap receiving portion 1891 and second strap receiving portion 1892 may be disposed on heel foxing 1814.

In one embodiment, first strap receiving portion 1891 may be disposed on lateral side portion 1807. In particular, first strap receiving portion 1891 may be disposed on heel foxing 1814 near throat 1803. In a similar manner, second strap receiving portion 1892 may be disposed on medial side portion 1806. In some cases, second strap receiving portion 1892 may be disposed on heel foxing 1814 adjacent to throat 1803.

Referring to FIGS. 19-21, fastening portion 1724 of ankle strap 1720 may be fastened through first strap receiving portion 1891 and second strap receiving portion 1892. In particular, second end portion 1726 may be threaded through first strap receiving portion 1891. After threading through first strap receiving portion 1891, second end portion 1726 may be drawn over a front side of an ankle, as illustrated in FIG. 20. In other words, second end portion 1726 may be drawn across lateral insert 1752 and medial insert 1751. This allows second end portion 1726 to be threaded through second strap receiving portion 1892, as illustrated in FIG. 21. Following the insertion through second strap receiving portion 1892, second end portion 1726 may be drawn back across a front side of ankle and secured.

Generally, second end portion 1726 may be secured in various manners known in the art. In some embodiments, second end portion 1726 may be releasably secured to a portion of upper 1802. In other embodiments, second end portion 1726 may be releasably secured to a portion of ankle strap 1720.

In some embodiments, fastening portion 1724 may include a fastening system so that second end portion 1726 may be releasably secured to a portion of ankle strap 1720. In different embodiments, fastening portion 1724 may include various fastening systems known in the art. Examples of fastening systems include, but are not limited to, hook and loop fasteners, snap fasteners, lacing systems, zipper and straps.

Referring to FIGS. 20 and 21, fastening portion 1724 of ankle strap 1720 includes fastener portion 1735. In some cases, fastener portion 1735 may be a hook portion of a hook and loop fastening system. Similarly, second end portion 1726 may include fastener receiving portion 1736, as illustrated in FIG. 20. Fastener receiving portion 1736 may be a loop portion of a hook and loop fastening system. This arrangement allows fastener portion 1735 to releasably attach to fastener receiving portion 1736 and secure second end portion 1726 to fastening portion 1724, as illustrated in FIG. 21. With this configuration, ankle strap 1720 may be releasably secured to itself.

With ankle strap 1720 fastened, ankle strap 1720 may tighten upper 1802 around a foot disposed within article 1800. In particular, ankle strap 1720 may tighten upper 1802 at an ankle portion of article 1800. In some cases, medial ankle portion 1761 and lateral ankle portion 1762 may be pressed against an ankle as ankle strap 1720 tightens an ankle portion of article 1800. Using this arrangement, insert system 1750 can protect and support a foot and ankle disposed within upper 1802.

In some embodiments, an ankle strap that is independent of an insert system may be configured to tighten an upper around an ankle to increase support for an ankle. In some cases, the ankle strap may also be used to secure the insert system to the upper when an insert system is used with the upper. This arrangement can increase the flexibility of an insert system by allowing a wearer of an article to use an ankle strap alone or with an insert system for additional ankle support.

Figure 22:
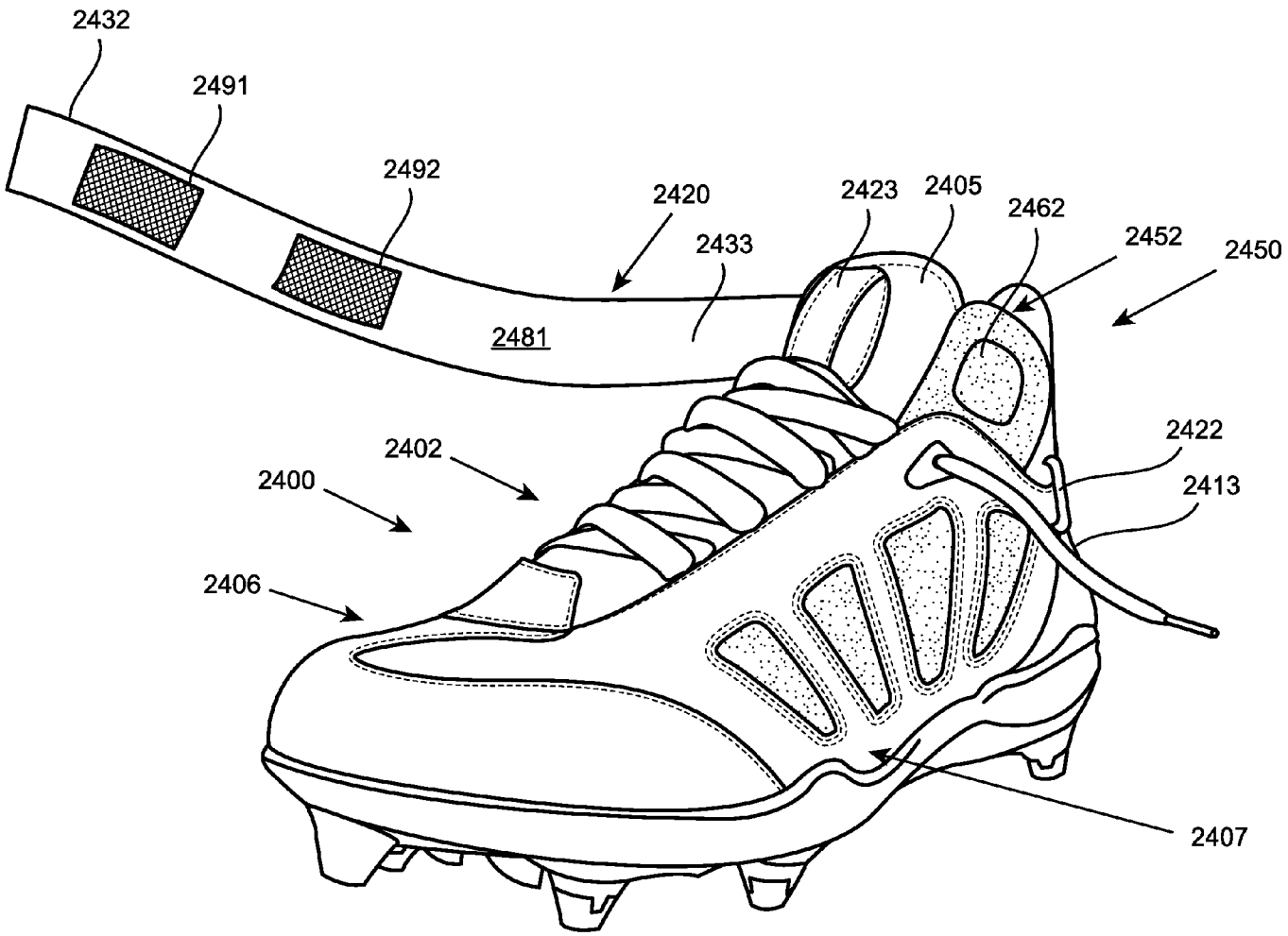
FIG. 22 is an isometric view of an exemplary embodiment of an insert system that may be fastened with an ankle strap to an article of footwear.
Figure 23:
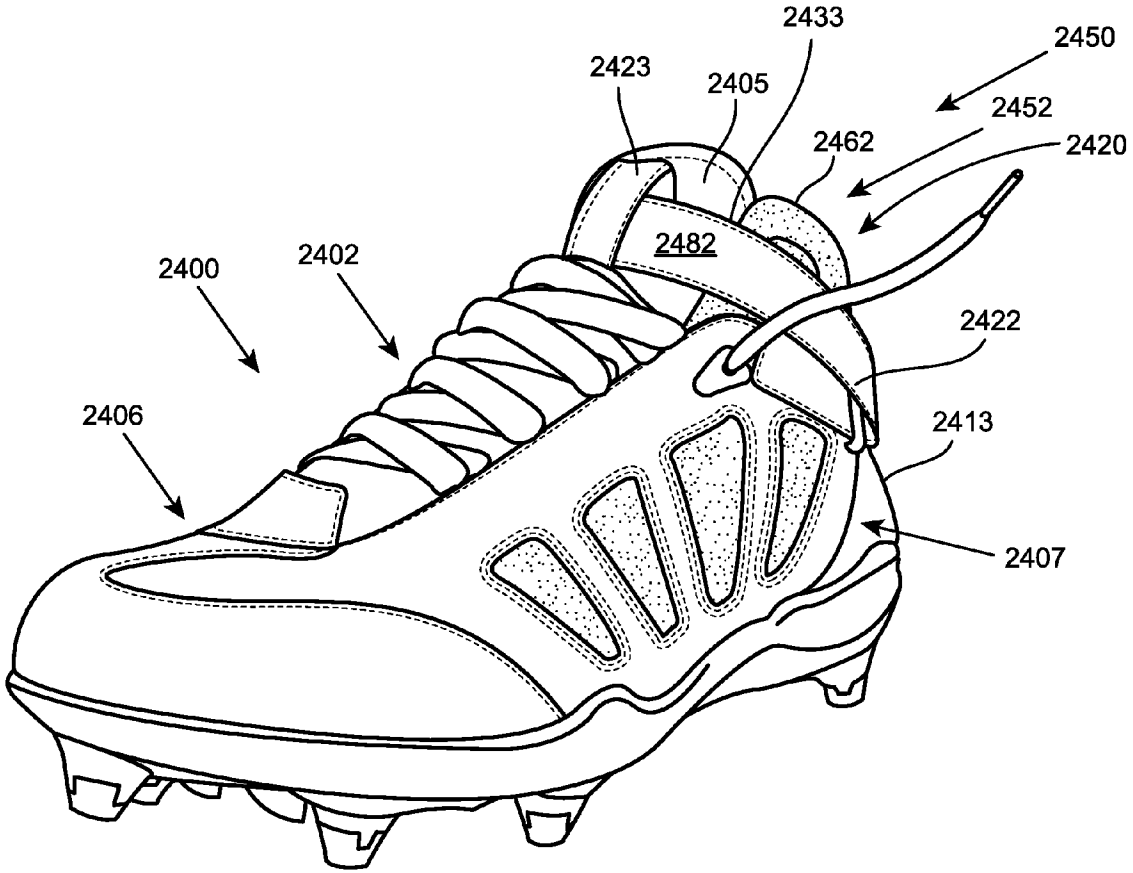
FIG. 23 is an isomeric view of an exemplary embodiment of an insert system fastened with an ankle strap to an article of footwear.
Figure 24:
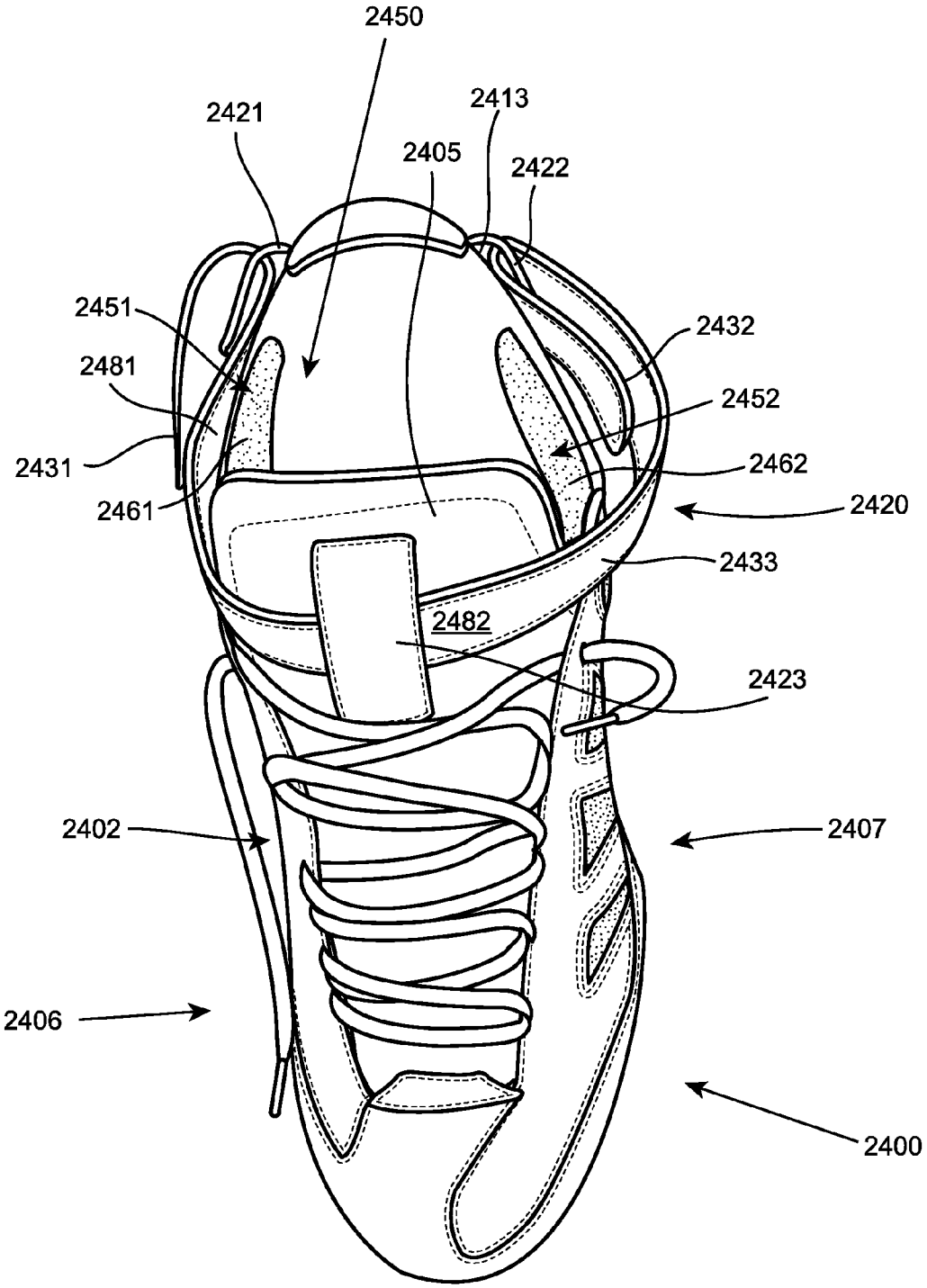
FIG. 24 is a top down view of an exemplary embodiment of an insert system fastened with an ankle strap to an article of footwear.

FIGS. 22-24 illustrate an exemplary embodiment of article of footwear 2400. Article of footwear 2400 includes upper 2402. In some embodiments, upper 2402 is a low top upper. Furthermore, upper 2402 may include medial side portion 2406 and lateral side portion 2407. In one embodiment, upper 2402 includes tongue portion 2405 disposed between medial side portion 2406 and lateral side portion 2407. In some cases, tongue portion 2405 may be associated with a fastening portion of upper 2402.

In an exemplary embodiment, insert system 2450 may be inserted within article of footwear 2400. Insert system 2450 may be configured to provide ankle support for a wearer of article 2400. In particular, medial insert 2451 and lateral insert 2452 of insert system 2450 include ankle portions to provide ankle support. For example, medial insert 2451 includes medial ankle portion 2461. Similarly, lateral insert 2452 includes lateral ankle portion 2462. With this arrangement, insert system 2450 may provide ankle support for a wearer of article 2400.

In order to tighten upper 2402 at an ankle portion of article 2400, article of footwear 2400 may be associated with ankle strap 2420. Ankle strap 2420 may include first end portion 2431 and second end portion 2432, disposed opposite first end portion 2431. Also, ankle strap 2420 may include intermediate portion 2433 disposed between first end portion 2431 and second end portion 2432. Furthermore, ankle strap 2420 may include first side portion 2481 and second side portion 2482, disposed opposite first side portion 2481.

In some embodiments, upper 2402 may include one or more strap receiving portions to fasten ankle strap 2420 to article 2400. In one embodiment, upper 2402 may include first strap receiving portion 2421, second strap receiving portion 2422 and third strap receiving portion 2423. First strap receiving portion 2421 may be disposed on heel foxing 2413 of upper 2402, as illustrated in FIG. 24. In particular, first strap receiving portion 2421 may be disposed on medial side portion 2406 of heel foxing 2413. Similarly, second strap receiving portion 2422 may be disposed on lateral side portion 2407 of heel foxing 2413. In addition, third strap receiving portion 2423 may be disposed on tongue portion 2405 of upper 2402.

Generally, first strap receiving portion 2421, second strap receiving portion 2422 and third strap receiving portion 2423 may receive ankle strap 2420 in any manner known in the art. In one embodiment, first strap receiving portion 2421 and second strap receiving portion 2422 may be D-rings. In contrast, third strap receiving portion 2423 may be a loop that receives ankle strap 2420.

In some embodiments, ankle strap 2420 may include provisions to fasten to strap receiving portions. Referring to FIG. 22, first side portion 2481 includes fastener portion 2491 and fastener receiving portion 2492. In particular, fastener portion 2491 and fastener receiving portion 2492 may be disposed on first side portion 2481 adjacent to second end portion 2432. In some cases, fastener portion 2491 and fastener receiving portion 2492 may be hook and loop type fasteners. However, in other cases, fastener portion 2491 and fastener receiving portion 2492 may be other types of fasteners. With this arrangement, fastener portion 2491 and fastener receiving portion 2492 may fasten to each other to secure second end portion 2432 to a strap receiving portion of upper 2402.

Although not illustrated for purposes of clarity in FIGS. 22-24, second side portion 2482 may also include a fastener portion and a fastener receiving portion. In some cases, a fastener portion and a fastener receiving portion on second side portion 2482 may be disposed adjacent to first end portion 2431. This can allow second side portion 2482 to fasten around a strap receiving portion at first end portion 2431. For example, first end portion 2431 may be fastened to first strap receiving portion 2421 by folding second side portion 2482 around first strap receiving portion 2421 and attaching a fastener portion and a fastener receiving portion.

Following the fastening of first end portion 2431 to first strap receiving portion 2421, ankle strap 2420 may wrap around medial ankle portion 2461 of medial insert 2451, as illustrated in FIG. 24. In some embodiments, ankle strap 2420 may be releasably attached to medial insert 2451. In an exemplary embodiment, ankle strap 2420 may instead only wrap around medial ankle portion 2461 in order to tighten medial insert 2451 to an ankle.

Referring to FIGS. 23 and 24, second end portion 2432 may be inserted through third strap receiving portion 2423 in tongue portion 2405 to fasten ankle strap 2420 to upper 2402. Following the threading of second end portion 2432 through third strap receiving portion 2423, ankle strap 2420 may wrap around lateral ankle portion 2462. As ankle strap 2420 wraps around lateral ankle portion 2462, second end portion 2432 may be pulled to tighten ankle strap 2420 around upper 2402 at an ankle portion of article 2400. Second end portion 2432 may then be secured to second strap receiving portion 2422. This may be accomplished by folding second end portion 2432 around second strap receiving portion 2422 so that first side 2481 is disposed against itself. This arrangement allows fastener portion 2491 to releasably attach to fastener receiving portion 2492, as illustrated in FIG. 22, to secure second end portion 2432 to second strap receiving portion 2422. With this arrangement, ankle strap 2420 may tighten upper 2402 at an ankle portion of article 2400 and simultaneously secure insert system 2450 in place.

Figure 25:
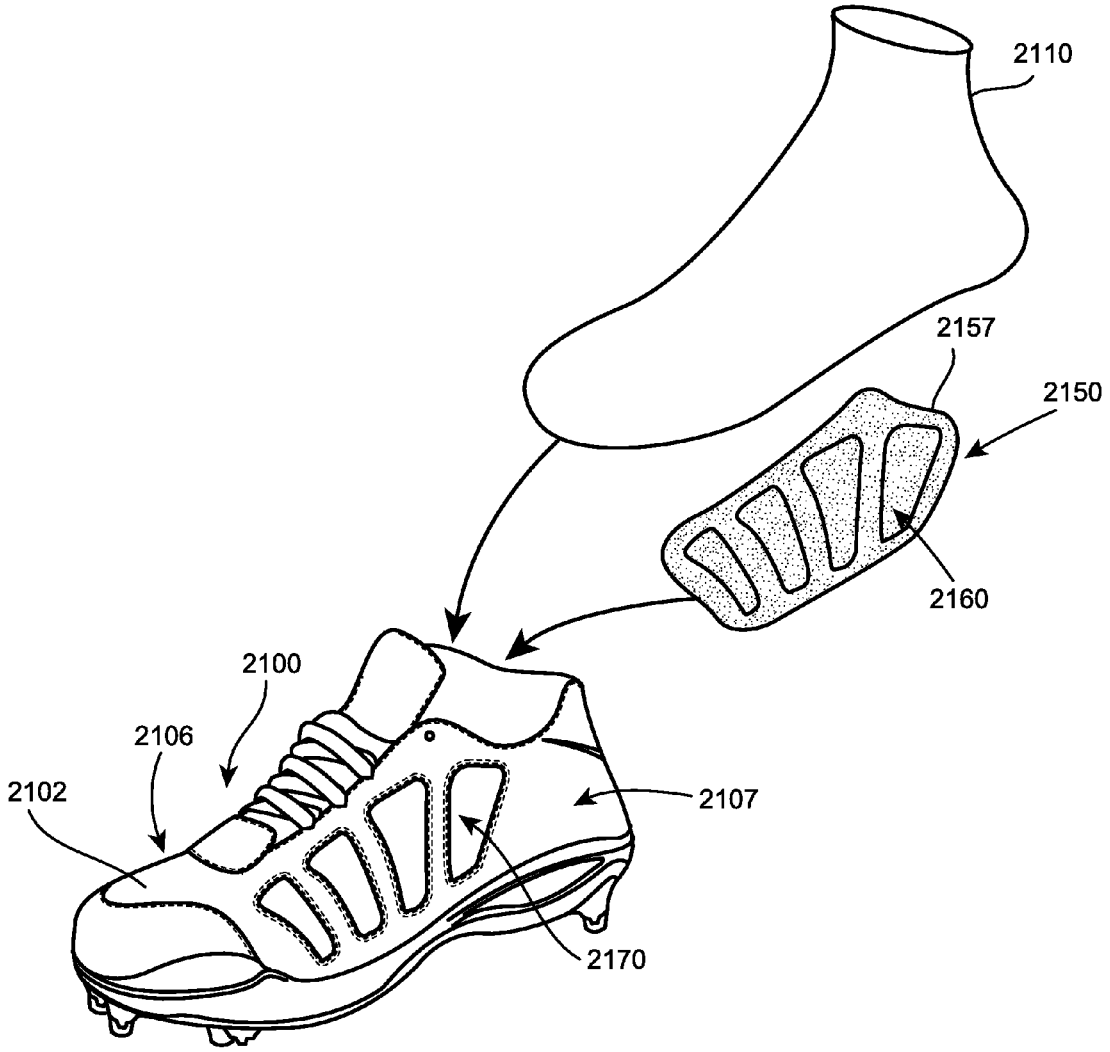
FIG. 25 is an isometric view of an exemplary embodiment of an article of footwear associated with an insert system and a bootie.
Figure 26:
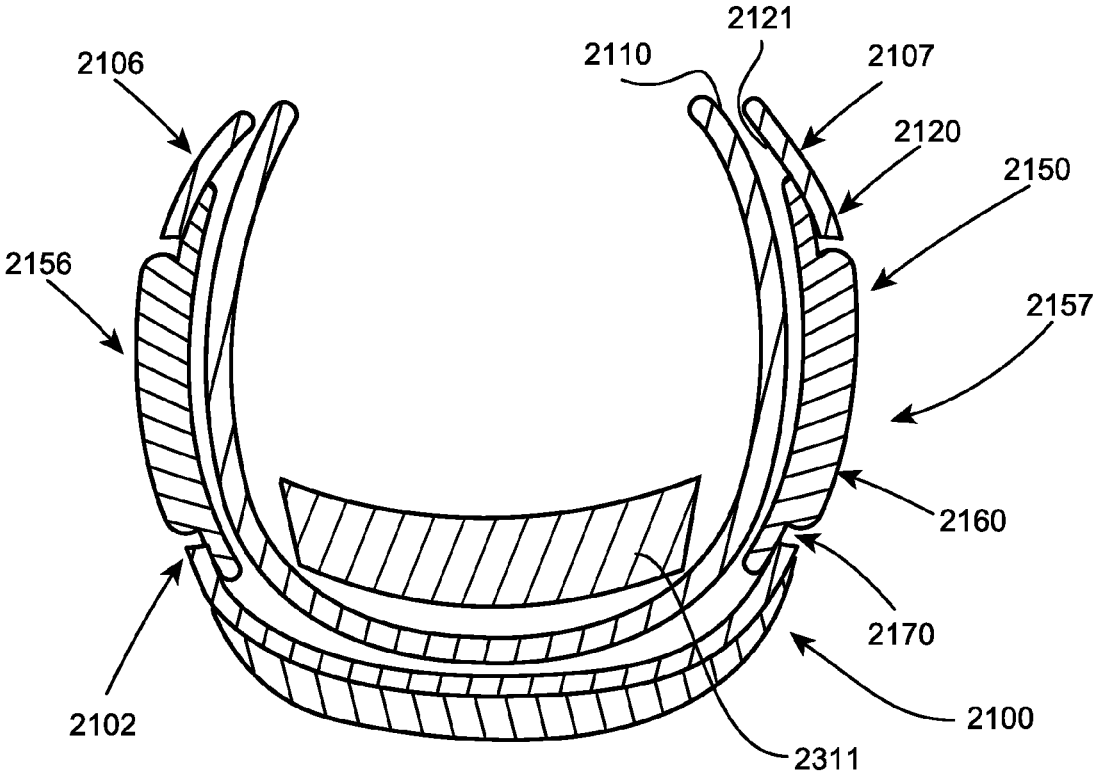
FIG. 26 is a schematic cross sectional view of an exemplary embodiment of an article of footwear with an insert system and a bootie.

In some embodiments, an article of footwear may be associated with a sock liner and/or bootie as well as an insert system. In embodiments with a bootie, inserts can be disposed between an outer lining of an upper and a bootie. FIGS. 25 and 26 illustrate an exemplary embodiment of article 2100 associated with bootie 2110 and insert system 2150. In particular, FIG. 25 is an isometric exploded view of an exemplary embodiment of article 2100 and FIG. 26 is a cross sectional view of an exemplary embodiment of bootie 2110 and insert system 2150 inserted within article 2100. The cross sectional view of FIG. 26 is similar to the view discussed with respect to FIG. 6.

In some embodiments, article 2100 may be associated with bootie 2110. Generally, bootie 2110 may be any type of bootie that may cover a foot. In some cases, bootie 2110 may include sock liner 2311, as illustrated in FIG. 26. Sock liner 2311 may be disposed adjacent to a bottom of a foot inserted within bootie 2110. With this arrangement, bootie 2110 may provide comfort to a foot inserted within article 2100.

Article 2100 may also be associated with insert system 2150. Insert system 2150 may include lateral insert 2157 and medial insert 2156, not illustrated in FIG. 25 for purposes of clarity. Lateral insert 2157 may be associated with an inner portion of lateral side portion 2107 of upper 2102 of article 2100. Similarly, medial insert 2156 may be associated with an inner portion of medial side portion 2106 of upper 2102. Medial insert 2156 and lateral insert 2157 may be configured with plurality of raised portions 2160. Plurality of raised portions 2160 may be configured to engage plurality of apertures 2170 of medial side portion 2106 and lateral side portion 2107 of upper 2102.

Referring to FIG. 26, bootie 2110 and insert system 2150 may be inserted within upper 2102. Medial insert 2156 may be disposed between bootie 2110 and medial side portion 2106. In particular, medial insert 2156 may be disposed adjacent to outer lining 2120 of upper 2102 and bootie 2110. Similarly, lateral insert 2157 may be disposed between bootie 2110 and lateral side portion 2107. In some cases, lateral insert 2157 may be disposed between bootie 2110 and interior portion 2121 of outer lining 2120 of upper 2102. This arrangement allows bootie 2110 to provide comfort to a foot disposed adjacent to medial insert 2156 and lateral insert 2157. With this arrangement, bootie 2110 may help maintain the alignment of medial insert 2156 and lateral insert 2157 with medial side portion 2106 and lateral side portion 2107, respectively.

It is also possible to use different options that have been described to form inserts that adjust multiple properties of a side portion of an upper. For example, an insert system may comprise inserts with substantially different shapes to accommodate different shapes of a foot as well as different sizes to provide distinct levels of support for different types of activities. By combining different options for an insert, a user may make subtle adjustments to a side portion of an article to increase the usability or comfort of the article.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper including a top portion designed to correspond with the top of a wearer's foot, a toe portion designed to correspond with a wearer's toes, a heel portion opposite the toe portion, a middle portion disposed between the toe portion and the heel portion, a medial side foot portion, and a lateral side foot portion opposite the medial side foot portion, wherein the medial side foot portion and the lateral side foot portion each include an outer surface and an inner surface that is opposite the outer surface, wherein the medial side foot portion is bounded by the heel portion, the toe portion, and a medial free edge disposed on a medial side of the top portion and wherein the lateral side foot portion is bounded by the heel portion, the toe portion, and a lateral free edge disposed on a lateral side of the top portion;

a sole attached to the upper;

the medial side foot portion including a first aperture;

the lateral side foot portion including a second aperture;

a medial insert including a first edge, a second edge opposite the first edge, and a first raised portion disposed between the first edge and the second edge, the medial insert being configured to be inserted into the upper on the medial side foot portion such that (a) the first raised portion is exposed through the upper by the first aperture, (b) the first raised portion fills the first aperture, (c) the first edge, the second edge, and an area of the medial insert immediately surrounding the first raised portion are adjacent to the inner surface of the medial side foot portion and are covered by the upper, and (d) the first edge and the second edge are both disposed between the medial free edge and the sole;

a lateral insert including a third edge, a fourth edge opposite the third edge, and a second raised portion disposed between the third edge and the fourth edge, the lateral insert being configured to be inserted into the upper such that (a) the second raised portion is exposed through the upper by the second aperture, (b) the second raised portion fills the second aperture, and (c) the third edge, the fourth edge, and an area of the lateral insert immediately surrounding the second raised portion are adjacent to the inner surface of the lateral side foot portion and are covered by the upper, and (d) the third edge and the fourth edge are both disposed between the lateral free edge and the sole, wherein the medial insert and the lateral insert are each individually replaceable.

2. The article of footwear according to claim 1, wherein the entirety of the first raised portion is disposed forward of the wearer's malleolus bone when the lateral insert is disposed within the upper.

3. The article of footwear according to claim 1, further comprising a first set of inserts configured to individually replace the medial insert and a second set of inserts configured to individually replace the lateral insert.

4. The article of footwear according to claim 3, wherein each insert of the first set of inserts has a different thickness and wherein each insert of the second set of inserts has a different thickness.

5. The article of footwear according to claim 3, wherein each insert of the first set of inserts has a different rigidity and wherein each insert of the second set of inserts has a different rigidity.

6. The article of footwear according to claim 1, wherein the medial insert includes a first ankle portion configured to extend above a throat of the upper when the medial insert is inserted in the upper and the lateral insert includes a second ankle portion configured to extend above the throat of the upper when the lateral insert is inserted in the upper.

7. The article of footwear according to claim 1, wherein a thickness of the medial insert is different from a thickness of the lateral insert.

8. An article of footwear, comprising:

an upper including a top portion designed to correspond with the top of a wearer's foot, a toe portion designed to correspond with a wearer's toes, a heel portion opposite the toe portion, a middle portion disposed between the toe portion and the heel portion, a medial side foot portion, and a lateral side foot portion opposite the medial side foot portion, wherein the medial side foot portion and the lateral side foot portion each include an outer surface and an inner surface that is opposite the outer surface, wherein the medial side foot portion is bounded by the heel portion, the toe portion, and a medial free edge disposed on a medial side of the top portion and wherein the lateral side foot portion is bounded by the heel portion, the toe portion, and a lateral free edge disposed on a lateral side of the top portion;

the medial side foot portion including a first aperture and a second aperture substantially aligned with the first aperture, wherein the first aperture and second aperture are both disposed between the medial free edge and the sole;

the lateral side foot portion including a third aperture and a fourth aperture substantially aligned with the third aperture, wherein the third aperture and fourth aperture are both disposed between the lateral free edge and the sole;

a medial insert configured to be inserted into the medial side foot portion of the upper such that a portion of the medial insert is adjacent to the inner surface of the medial side foot portion;

a lateral insert that is separate from the lateral side foot portion and is configured to be inserted into the lateral side foot portion of the upper such that a portion of the lateral insert is adjacent to the inner surface of the lateral side foot portion;

the medial insert including a first raised portion and a second raised portion aligned with the first raised portion, the first raised portion being configured to fill the first aperture such that the first raised portion is exposed through the upper and the second raised portion being configured to fill the second aperture such that the second raised portion is exposed through the upper when the medial insert is disposed inside the medial side foot portion;

the lateral insert including a third raised portion and a fourth raised portion aligned with the third raised portion, the third raised portion being configured to fill the third aperture such that the third raised portion is exposed through the upper and the fourth raised portion being configured to fill the fourth aperture such that the fourth raised portion is exposed through the upper when the lateral insert is disposed inside the lateral side foot portion; and wherein the medial insert and the lateral insert are each individually replaceable.

9. The article of footwear according to claim 8, further comprising a first set of inserts configured to individually replace the medial insert and a second set of inserts configured to individually replace the lateral insert, wherein each insert of the first set of inserts has a different thickness and each insert of the second set of inserts has a different thickness.

10. The article of footwear according to claim 8, further comprising an ankle strap fixedly connected to a portion of one of the medial insert and the lateral insert.

11. The article of footwear according to claim 8, wherein a thickness of the medial insert is different from a thickness of the lateral insert.

12. The article of footwear according to claim 8, wherein a rigidity of the medial insert is different from a rigidity of the lateral insert.

13. The article of footwear according to claim 8, wherein the medial side portion is configured to receive the medial insert when the lateral insert is not inserted in the upper.

14. The article of footwear according to claim 13, wherein the medial insert includes a first ankle portion that extends at an angle from the throat of the upper when the medial insert is inserted into the upper and the lateral insert includes a second ankle portion that extends at an angle from the throat of the upper when the lateral insert is inserted into the upper.

15. An article of footwear, comprising:

an upper including a top portion designed to correspond with the top of a wearer's foot, a toe portion designed to correspond with a wearer's toes, a heel portion opposite the toe portion, a middle portion disposed between the toe portion and the heel portion, a medial side foot portion, and a lateral side foot portion opposite the medial side foot portion, wherein the medial side foot portion and the lateral side foot portion each include an outer surface and an inner surface that is opposite the outer surface, wherein the medial side foot portion is bounded by the heel portion, the toe portion, and a medial free edge disposed on a medial side of the top portion and wherein the lateral side foot portion is bounded by the heel portion, the toe portion, and a lateral free edge disposed on a lateral side of the top portion;

the medial side portion including a first aperture, wherein the first aperture is disposed between the medial free edge and the sole;

the lateral side portion including a second aperture, wherein the second aperture is disposed between the lateral free edge and the sole;

a medial insert configured to be inserted into the upper such that a portion of the medial insert is adjacent to the inner surface of the medial side portion, the medial insert including a first raised portion that is configured to be inserted through the first aperture and exposed on the outer surface of the medial side portion, wherein the medial insert further includes a first ankle portion that extends from a throat of the upper when the medial insert is inserted into the upper and wherein the first ankle portion is narrower than the rest of the medial insert;

a lateral insert configured to be inserted into the upper such that a portion of the lateral insert is adjacent to the inner surface of the lateral side portion, the lateral insert including a second raised portion that is configured to be inserted through the second aperture and exposed on the outer surface of the lateral side portion, wherein the lateral insert further includes a second ankle portion that extends from the throat of the upper when the lateral insert is inserted into the upper and wherein the second ankle portion is narrower than the rest of the lateral insert;

an ankle strap fixedly connected to a portion of one of the medial insert and the lateral insert;

wherein the ankle strap is configured to engage a strap receiving portion disposed near an opening of the upper and wherein the ankle strap is configured to tighten the upper at an ankle portion of the article; and wherein the medial insert and the lateral insert are each individually replaceable.

16. The article of footwear according to claim 15, further comprising:

a first set of inserts configured to individually replace the medial insert; and a second set of inserts configured to individually replace the lateral insert.

17. The article of footwear according to claim 16, wherein one of the first medial insert and the second medial insert includes a slot configured to receive the ankle strap.

18. The article of footwear according to claim 15, wherein the first ankle portion extends at an angle from the rest of the medial insert and the second ankle portion extends at an angle from the rest of the lateral insert.

19. The article of footwear according to claim 15, wherein the upper includes at least two strap receiving portions.

20. The article of footwear according to claim 15, wherein the medial side portion includes a first plurality of apertures, the medial insert includes a first plurality of raised portions configured to be inserted through the first plurality of apertures and exposed on the outer surface of the medial side portion, the lateral side portion includes a second plurality of apertures, and the lateral insert includes a second plurality of raised portions configured to be inserted through the second plurality of apertures and exposed on the outer surface of the lateral side portion.

* * * * *